US012807439B2

(12) United States Patent
Shimizu

(10) Patent No.: US 12,807,439 B2
(45) Date of Patent: Nov. 24, 2026

(54) SHEET STACKING APPARATUS, IMAGE FORMING SYSTEM, AND INFORMATION PROCESSING APPARATUS

(71) Applicant: CANON FINETECH NISCA INC., Saitama (JP)

(72) Inventor: Naoki Shimizu, Yamanashi (JP)

(73) Assignee: CANON FINETECH NISCA INC., Saitama (JP)

( * ) Notice: Subject to any disclaimer, the term of this patent is extended or adjusted under 35 U.S.C. 154(b) by 0 days.

(21) Appl. No.: 19/095,526

(22) Filed: Mar. 31, 2025

(65) Prior Publication Data

US 2025/0230007 A1 Jul. 17, 2025

Related U.S. Application Data

(63) Continuation of application No. PCT/JP2023/036751, filed on Oct. 10, 2023.

(30) Foreign Application Priority Data

Oct. 11, 2022 (JP) ..... 2022-163233

(51) Int. Cl.
*B65H 35/04* (2006.01)
*B65H 7/02* (2006.01)
*B65H 35/00* (2006.01)

(52) U.S. Cl.
CPC ..... *B65H 7/02* (2013.01); *B65H 35/0073* (2013.01); *B65H 2511/514* (2013.01); *B65H 2515/10* (2013.01); *B65H 2801/03* (2013.01)

(58) Field of Classification Search
CPC ..... B31F 31/00; B31F 35/04; B31F 35/0073; B31F 2301/4213; B31F 2701/121;
(Continued)

(56) References Cited

U.S. PATENT DOCUMENTS 5,609,333 A * 3/1997 Mandel ..... B65H 43/06 270/58.11
7,448,615 B2 * 11/2008 Takamura ..... B42C 1/12 270/58.11

(Continued)

FOREIGN PATENT DOCUMENTS

JP 2009-249080 A 10/2009
JP 2012-066929 A 4/2012

(Continued)

OTHER PUBLICATIONS

International Search Report dated Nov. 16, 2023, in related PCT International Patent Application No. PCT/JP2023/036751.

*Primary Examiner* — Leslie A Nicholson, III
(74) *Attorney, Agent, or Firm* — VENABLE LLP

(57) ABSTRACT

A sheet stacking apparatus includes a conveyance unit, a discharge unit, a stacking unit that stacks the sheet being discharged by the discharge unit, and a control unit that stops a stacking operation of the sheet to the stacking unit according to an amount of sheets stacked on the stacking unit. The control unit stops the stacking operation of the sheet on the stacking unit in response to having a first amount of sheets being stacked on the stacking unit, in a case where a sheet having no perforation provided thereon is stacked on the stacking unit, and stops the stacking operation of the sheet on the stacking unit in response to having an amount of sheets that is smaller than the first amount being stacked on the stacking unit, in a case where a sheet having a perforation provided thereon is stacked on the stacking unit.

12 Claims, 13 Drawing Sheets

(58) Field of Classification Search
CPC .... B31F 5/02; B31F 5/027; B31F 2201/0797; G03G 2215/00789
USPC ..... 493/355, 396; 270/58.07
See application file for complete search history.

(56) References Cited

U.S. PATENT DOCUMENTS

| | | | | |
|---|---|---|---|---|
| 8,672,314 | B2 | 3/2014 | Sato et al. | |
| 11,104,539 | B1 * | 8/2021 | Sugizaki | B65H 31/02 |

FOREIGN PATENT DOCUMENTS

| | | | |
|---|---|---|---|
| JP | 5825914 | B2 | 12/2015 |
| JP | 2019-206420 | A | 12/2019 |

* cited by examiner

SHEET STACKING APPARATUS, IMAGE FORMING SYSTEM, AND INFORMATION PROCESSING APPARATUS

CROSS-REFERENCE TO RELATED APPLICATIONS

This application is a Continuation of International Patent Application No. PCT/JP2023/036751, filed Oct. 10, 2023, which claims the benefit of Japanese Patent Application No. 2022-163233, filed Oct. 11, 2022, both of which are hereby incorporated by reference herein in their entirety.

BACKGROUND OF THE INVENTION

Field of the Invention

The present invention relates to a sheet stacking apparatus for stacking sheets that have been subjected to a processing for forming perforation on sheets being conveyed, and an image forming system and an information processing apparatus equipped with the sheet stacking apparatus.

Background Art

Hitherto, sheet processing apparatuses that form perforation on sheets being discharged from image forming apparatuses are known (refer for example to "Patent Literature 1"). The sheet processing apparatus disclosed in Patent Literature 1 conveys sheets on which perforation has been formed in the sheet processing apparatus toward a downstream side, and conveys the same to a finisher. Hitherto, finishers are known to be equipped with a stacking tray for stacking sheets (refer for example to "Patent Literature 2"), and also according to the apparatus disclosed in Patent Literature 1, sheets having perforation provided thereon is stacked on the stacking tray.

CITATION LIST

Patent Literature

[Patent Literature 1] Japanese Patent Application Laid-Open Publication No. 2019-206420

[Patent Literature 2] Japanese Patent No. 5825914

In order to form perforation on sheets, multiple minute perforation holes or slits are formed approximately linearly with an interval therebetween in a direction orthogonal to a sheet conveyance direction, but unlike a hole punching process, so-called punching, the portion on which the perforation hole is formed is not cut out, a projected portion, such as a burr or flash, in a sheet thickness direction is formed around each of the holes constituting the perforation.

If multiple sheets having been subjected to perforation processing and having projected portions described above formed thereon through perforation are stacked on a stacking tray of a finisher, the area where the projected portions are formed rises, and the stacking state is deteriorated.

SUMMARY OF THE INVENTION

According to one aspect of the present invention, a sheet stacking apparatus includes a conveyance unit configured to convey a sheet in a predetermined conveyance direction, a discharge unit configured to discharge the sheet conveyed by the conveyance unit, a stacking unit configured to stack the sheet discharged from the discharge unit, and a control unit configured to stop a stacking operation of the sheet on the stacking unit according to an amount of sheets stacked on the stacking unit, wherein the control unit is configured to stop the stacking operation of the sheet on the stacking unit in response to having a first amount of sheets being stacked on the stacking unit, in a case where a sheet having no perforation provided thereon is stacked on the stacking unit, and stop the stacking operation of the sheet on the stacking unit in response to having an amount of sheets that is smaller than the first amount being stacked on the stacking unit, in a case where a sheet having a perforation provided thereon is stacked on the stacking unit.

According to one aspect of the present invention, an information processing apparatus includes a memory configured to store a control program configured to control a stacking operation of a sheet on a stacking apparatus on which a sheet having been subjected to perforation processing by a perforation apparatus and a sheet having been conveyed from an image forming apparatus without being subjected to the perforation processing by the perforation apparatus are stacked, and a processor configured to execute the control program, wherein, in a state where the program is executed by the processor, in a case where the sheet having been subjected to a predetermined perforation processing is stacked on the stacking apparatus, the processor is configured to stop the stacking of the sheet on the stacking apparatus based on a number of stacked sheets that is smaller than an upper limit number of stacked sheets of a case where a predetermined sheet that has not been subjected to perforation processing is stacked on the stacking apparatus.

According to one aspect of the present invention regarding a sheet stacking apparatus on which a sheet sent from an upstream side apparatus in a sheet conveyance direction is stacked, the sheet stacking apparatus includes a conveyance unit configured to convey the sheet sent from the upstream side apparatus, a discharge unit configured to discharge the sheet being conveyed by the conveyance unit, a stacking unit configured to stack the sheet being discharged from the discharge unit, and a control unit configured to acquire a perforation presence information of the sheet stacked on the stacking unit from the upstream side apparatus, and to control the discharge unit such that an upper limit of number of stacked sheets of the sheets being stacked on the stacking unit are varied, wherein, in a case where a predetermined sheet recognized to have a predetermined perforation provided thereto is stacked on the stacking unit, the control unit is configured to control the discharge unit to stop the stacking of the sheet on the stacking unit based on a number of stacked sheets that is smaller than an upper limit of number of stacked sheets of the predetermined sheet that is recognized to have no predetermined perforation provided thereto.

Further features of the present invention will become apparent from the following description of exemplary embodiments with reference to the attached drawings.

DESCRIPTION OF THE EMBODIMENTS

An embodiment of a present invention will be described below with reference to the drawings.

Figure 1:
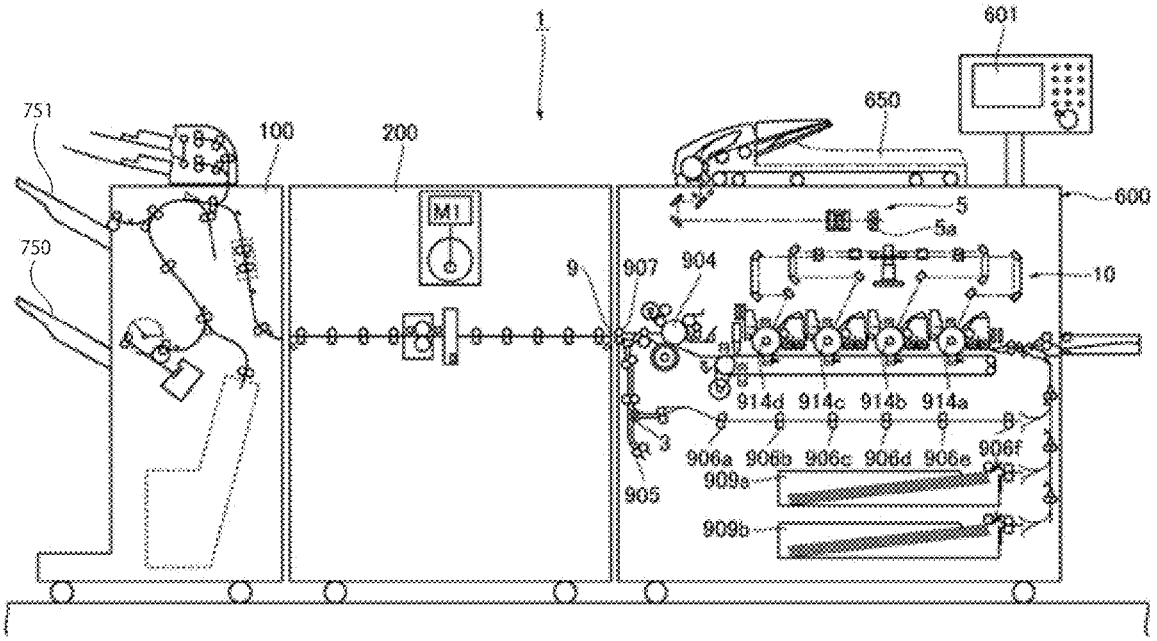
FIG. 1 is a cross-sectional view illustrating a configuration of a sheet processing apparatus and an image forming apparatus equipped with a sheet stacking apparatus according to the present invention.

An image forming system 1 includes, as illustrated in FIG. 1, an image forming apparatus 600, a sheet processing apparatus 200 arranged adjacent to a side surface of a body of the image forming apparatus, and a finisher 100 serving as a sheet stacking apparatus arranged adjacent to an opposite side as the image forming apparatus 600 of the sheet processing apparatus.

The image forming apparatus 600 includes a document feeder 650 and an operation unit 601, wherein a document fed by the document feeder 650 is read, and an image is formed on photosensitive drums 914*a* to 914*d*. A position at which a user faces the operation unit 601 to enter various inputs and settings of the image forming apparatus 600 is referred to as a front direction on a front side of the image forming system 1, hereinafter referred to as "front direction", and a back side of the apparatus is referred to as a rear direction.

Toner images of four colors, which are yellow, magenta, cyan, and black, are transferred by the photosensitive drums 914*a* to 914*d* serving as image bearing members to sheets supplied from sheet cassettes 909*a* and 909*b* in the image forming apparatus 600. The photosensitive drums 914*a* to 914*d* respectively constitute an image forming unit for forming toner images on sheets. The toner images are conveyed to a fixing unit 904 where the toner images are fixed, and if a simplex image forming mode is selected, the sheet is discharged in this state by a sheet discharge roller 907 to an exterior of the image forming apparatus 600. In a duplex image forming mode, the sheet is transferred from the fixing unit 904 to a reverse conveyance roller 905. Then, when a trailing edge in a conveyance direction of the sheet moves beyond a reverse flapper 3, the reverse conveyance roller 905 is rotated in a reverse direction. Thereby, the sheet is conveyed toward the direction of a duplex conveyance rollers 906*a* to 906*f*, which is an opposite direction from the sheet conveyance direction.

Then, a toner image of four colors is transferred again from the photosensitive drums 914*a* to 914*d* of yellow, magenta, cyan, and black to a back surface side of the sheet. The sheet having toner images transferred to both surfaces thereof is conveyed again to the fixing unit 904, where the toner image is fixed, and then discharged to the exterior of the image forming apparatus 600 by the sheet discharge roller 907.

The sheet processing apparatus 200 conveys the sheet discharged by the sheet discharge roller 907 of the image forming apparatus 600 toward the finisher 100, and also subjects the sheet to a perforation formation processing described later in midway of the conveyance.

The finisher 100 receives the sheet discharged from the sheet processing apparatus 200 serving as a perforation processing apparatus and discharges the sheet onto a lower stacking tray 750, or an upper stacking tray 751, but the sheet may also be discharged onto the lower stacking tray 750 after subjecting the sheet to a postprocessing, such as a stapling process or a bundle alignment, based on the setting of the user.

The sheets discharged from the image forming apparatus 600 may be processed by the sheet processing apparatus 200 and the finisher 100, which are connected on-line. Further, the image forming apparatus 600 may be used alone without connecting the sheet processing apparatus 200 to a sheet discharge port 9. The image forming apparatus 600 may have the sheet processing apparatus 200 and the finisher 100 assembled integrally as a sheet discharging apparatus. Further, the image forming apparatus 600 is not limited to an image forming apparatus body that performs the above-described color image forming, and it may be a monochrome image forming apparatus body.

Figure 2:
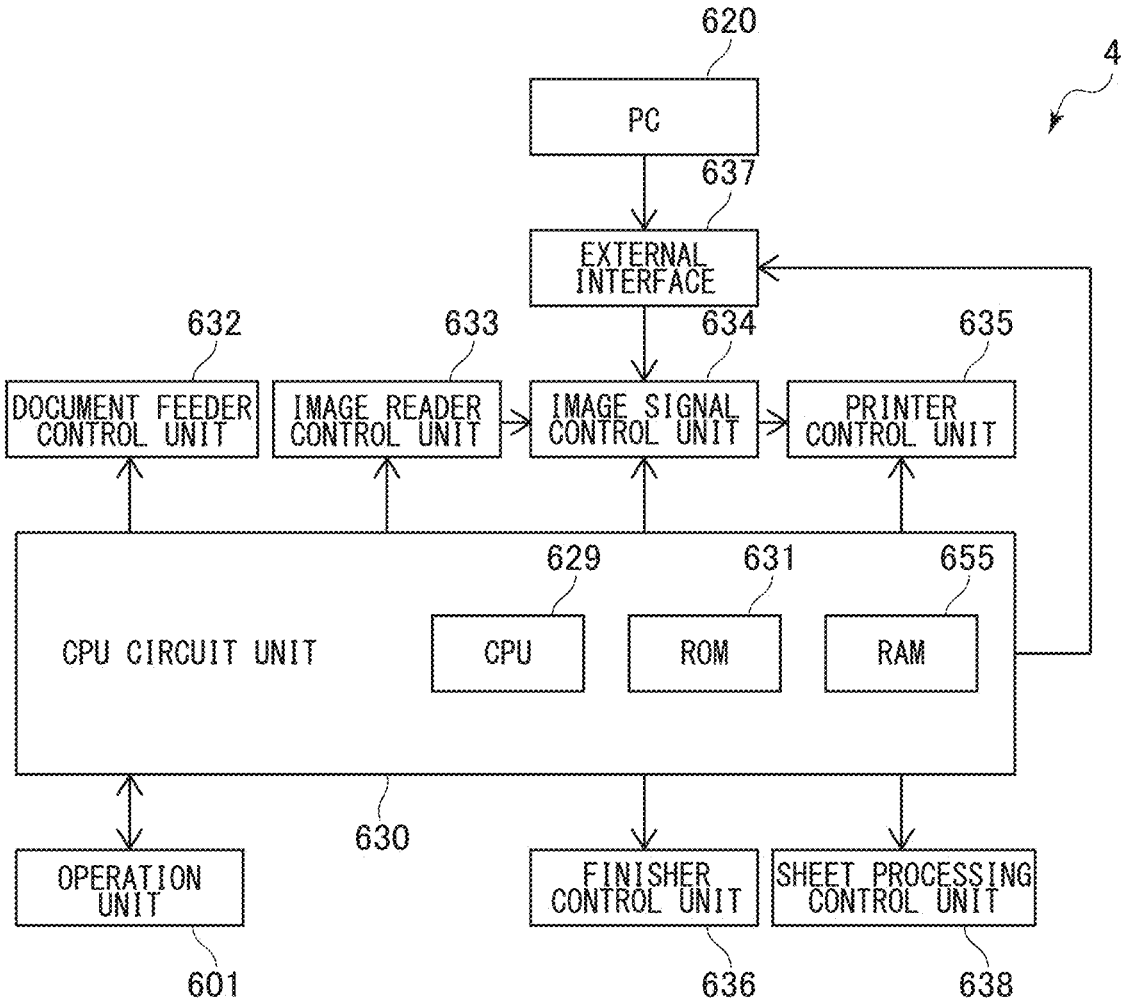
FIG. 2 is a block diagram illustrating a configuration of a control system of the sheet processing apparatus and the image forming apparatus equipped with the sheet stacking apparatus according to the present invention.

FIG. 2 is a block diagram illustrating a configuration of a control unit 4 that controls the image forming system 1. In FIG. 2, a CPU (Central Processing Unit) circuit unit 630 includes a CPU 629, a ROM (Read Only Memory) 631, and a RAM (Random-access Memory) 655. The CPU circuit unit 630 controls a document feeder control unit 632, an image reader control unit 633, an image signal control unit 634, a printer control unit 635, a finisher control unit 636, a sheet processing control unit 638, and an external interface 637. The CPU circuit unit 630 performs control based on a program stored in a ROM 631 and the setting of the operation unit 601. The document feeder control unit 632 controls the document feeder 650. The image reader control unit 633 controls an image reader 5.

The printer control unit 635 controls the image forming apparatus 600. The sheet processing control unit 638 controls the sheet processing apparatus 200 that serves as a sheet processing unit for performing a predetermined processing to a sheet conveyed by a conveyance roller pair 211 that serves as a sheet conveyance unit illustrated in FIG. 3.

The finisher control unit 636 controls the finisher 100. In the present embodiment, a configuration is described in which the sheet processing control unit 638 is disposed in the sheet processing apparatus 200 and the finisher control unit 636 is disposed in the finisher 100.

The present invention is not limited thereto, and the sheet processing control unit 638 or the finisher control unit 636 may be disposed integrally with the CPU circuit unit 630 in the image forming apparatus 600, and the sheet processing apparatus 200 and the finisher 100 may be controlled from the image forming apparatus 600 side. Further, the finisher control unit 636 communicates with the image forming apparatus 600 and acquires a postprocessing information entered by an operator.

The RAM 655 may be used as an area for temporarily retaining control data, or as a working area for arithmetic operation accompanying control. The external interface 637 is an interface with a personal computer (PC) 620, and expands a print data as an image and outputs the same to the image signal control unit 634. An image read by an image sensor 5*a* is output from the image reader control unit 633 to the image signal control unit 634. Then, the image output from the image signal control unit 634 to the printer control unit 635 is entered to an exposure control unit not shown that controls a laser scanner 10 serving as an image exposing unit.

The sheet processing control unit 638 is disposed in the sheet processing apparatus 200, and performs drive control of the entirety of the sheet processing apparatus 200 by communicating information with the CPU circuit unit 630 of the image forming system 1. The finisher control unit 636 is disposed in the finisher 100, and performs drive control of the entirety of the finisher 100 by communicating information with the CPU circuit unit 630 of the image forming system 1. The sheet processing control unit 638 and the finisher control unit 636 controls the various motors and sensors provided in the image forming system 1.

Figure 3:
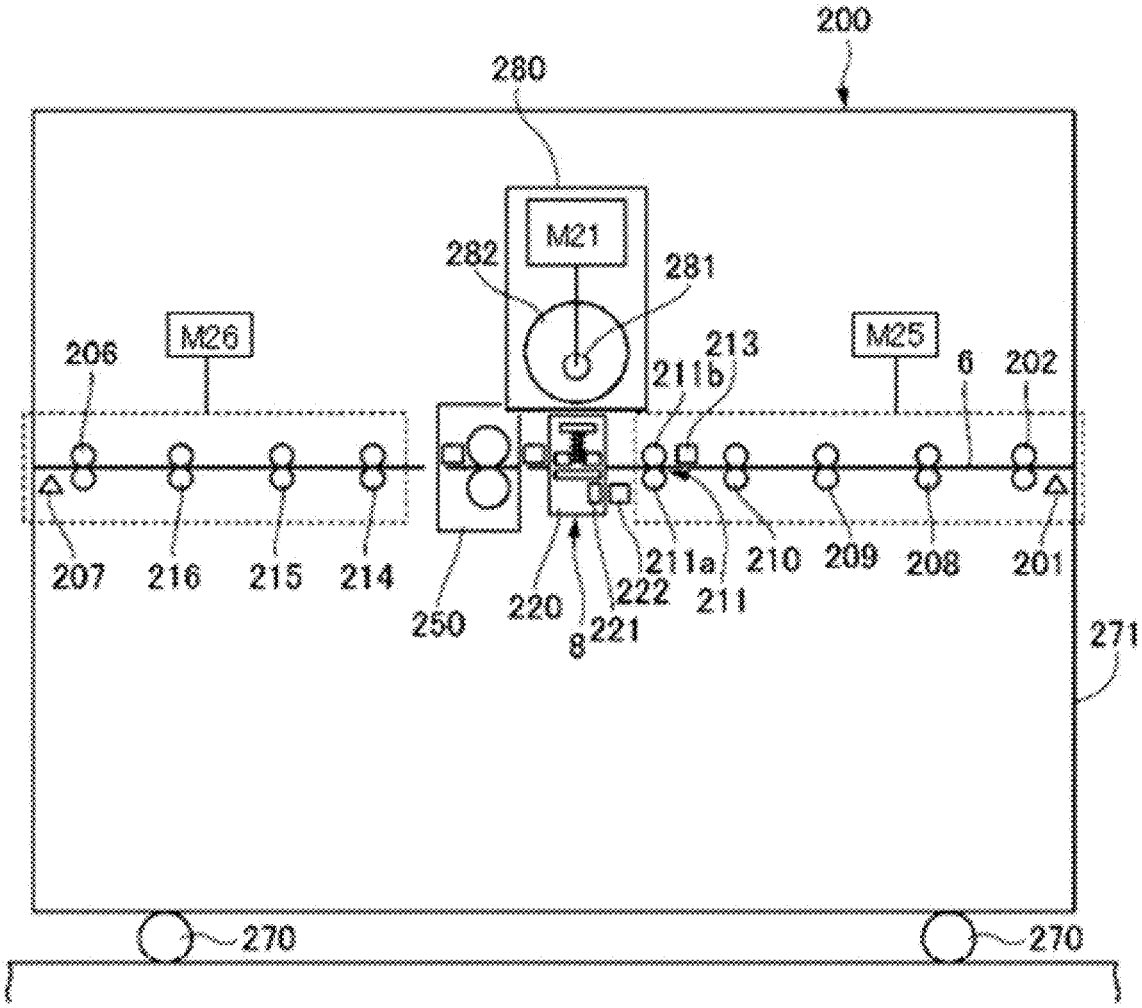
FIG. 3 is cross-sectional view of a configuration of the sheet processing apparatus.

Next, the sheet processing apparatus will be described with reference to FIGS. 3 and 5. The sheet processing apparatus 200 includes, as illustrated in FIG. 3, a casing 271 supported by a caster 270, and a sheet processing path 6 that extends in a horizontal direction within the casing 271 is arranged therein. A processing unit 8 is arranged in midway of the sheet processing path 6, and the processing unit 8 includes a sheet processing unit 220 that performs a perforation formation processing for forming perforation, and a lateral direction-skew registration correction unit (hereinafter referred to as lateral registration skew correction unit) 250 arranged adjacently on a downstream side of the sheet processing unit 220. A plurality of conveyance roller pairs 202, 208, 209, 210, and 211 are arranged along the sheet processing path 6 on an upstream side of the sheet processing unit 220, and each conveyance roller is configured such that, in the example of the conveyance roller pair 211, a driving, i.e., active, roller 211*a* is arranged on a lower side of the sheet processing path 6, and a driven roller 211*b* is arranged on an upper side in contact with the driving roller 211*a*. The driving rollers of these conveyance rollers are driven by a motor M25. Further, an inlet portion of the sheet processing path 6 is disposed in an aligned manner with the sheet discharge port 9 of the image forming apparatus 600, an inlet sensor 201 for detecting the sheet entering the sheet processing path 6 from the sheet discharge port 9 is disposed, and a sheet edge detection sensor 213 and a unit identification sensor 222 are arranged on the inlet side of the processing unit 8.

A plurality of conveyance roller pairs 214, 215, 216, and 206 are arranged along the sheet processing path 6 on a downstream side of the lateral registration skew correction unit 250, similar to the upstream side thereof, and a sheet discharge sensor 207 is arranged on the sheet discharge port thereof. The sheet discharge port of the sheet processing path 6 is aligned with a sheet path inlet portion of the finisher 100. The driving rollers of the downstream-side conveyance roller pairs 214, 215, 216, and 206 are driven by a motor M26.

Figure 5:
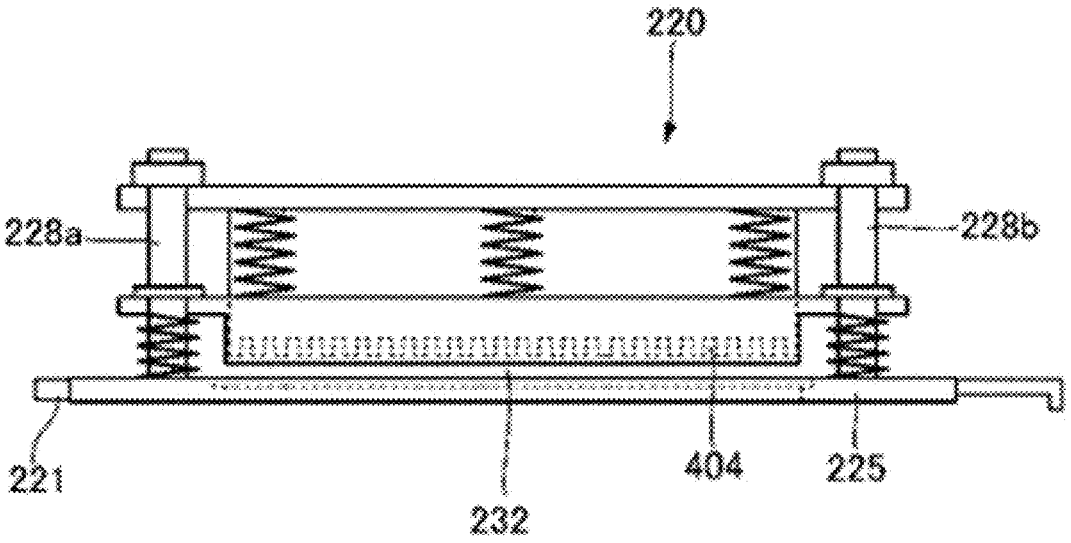
FIG. 5 is a side view illustrating the sheet processing apparatus from a downstream side in a conveyance direction.

The sheet processing unit 220 includes, as illustrated in FIG. 5, a die plate 225, and shaft guides 228*a* and 228*b* are erected at edge portions of the front direction and the rear direction of the die plate 225, wherein a perforation forming blade 404 is supported movably in an up-down direction on the shaft guides.

As illustrated in FIG. 3, a pressing drive unit 280 is arranged above the sheet processing unit 220. The pressing drive unit 280 includes a cam drive motor M21, and an eccentric cam 282 that is driven by the cam drive motor M21. The eccentric cam 282 is eccentrically rotated by a cam shaft 281 and presses the perforation forming blade 404. Further, the perforation forming blade may adopt various shapes, such as a rotating cutter configuration.

Next, an operation of the sheet processing apparatus 200 described above will be described. The sheet processing apparatus 200 sequentially takes in sheets discharged through the sheet discharge port 9 of the image forming apparatus 600. The sheet processing in the sheet processing apparatus 200 is operated according to a setting performed by the user through the operation unit 601 disposed on the image forming apparatus 600. The sheet discharged through the sheet discharge port 9 of the image forming apparatus 600 is transferred to the conveyance roller pair 202 of the sheet processing apparatus 200. In this state, a transfer timing of the sheet is simultaneously detected by the inlet sensor 201. The sheet is conveyed to the processing unit 8 by the conveyance roller pairs 208 to 211. Then, the sheet passes through a conveyance path 232 of the sheet processing unit 220 illustrated in FIGS. 3 and 5.

The sheet having passed through the conveyance path 232 stops when it reaches a predetermined position in the sheet conveyance direction, and the sheet is subjected to a perforation formation processing in a sheet width direction orthogonal to the sheet conveyance direction by the processing unit 8. A perforation according to the present specification refers to a line of slits that are formed in multiple numbers with an interval therebetween, or a succession of multiple fine punched holes, along a straight line in the sheet width direction from a first end to a second end, and a perforation formed by a single operation of a perforation processing mechanism described below is defined as one line of perforation.

Figure 6A:
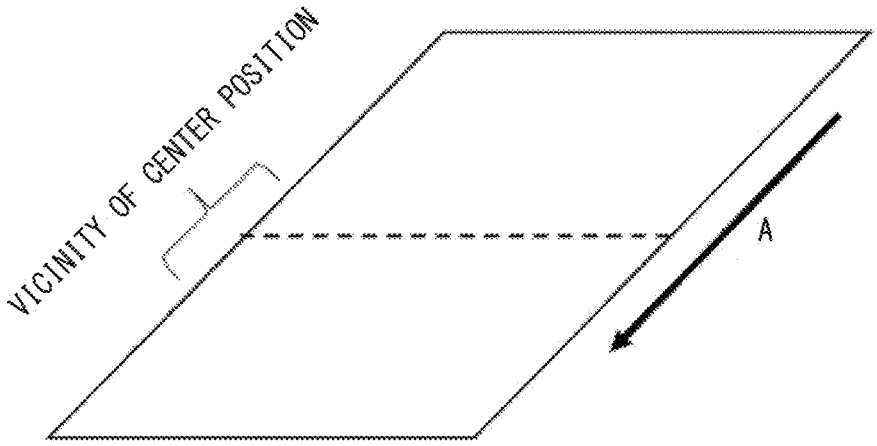
FIG. 6A is a perspective view of a sheet on which a processing, i.e., perforation, has been provided at a vicinity of a center position.
Figure 6B:
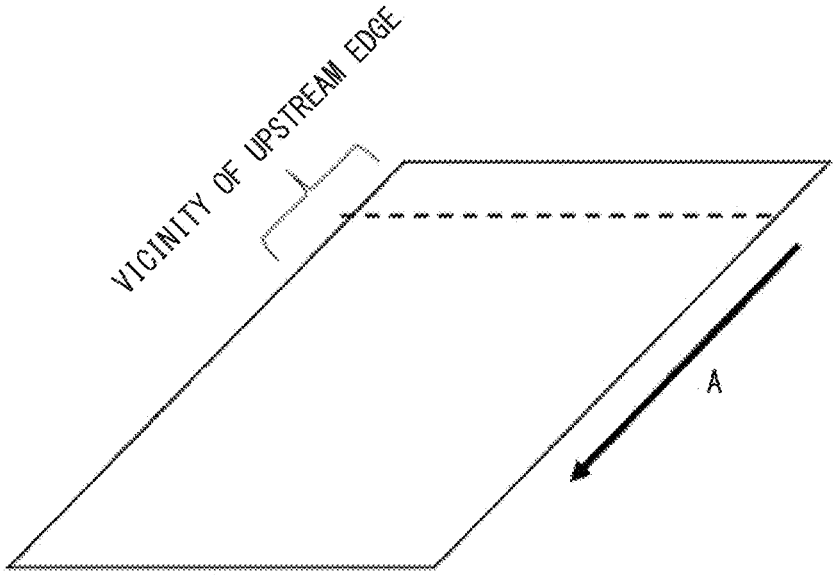
FIG. 6B is a perspective view of a sheet on which a processing, i.e., perforation, has been provided at a vicinity of an upstream edge.
Figure 6C:
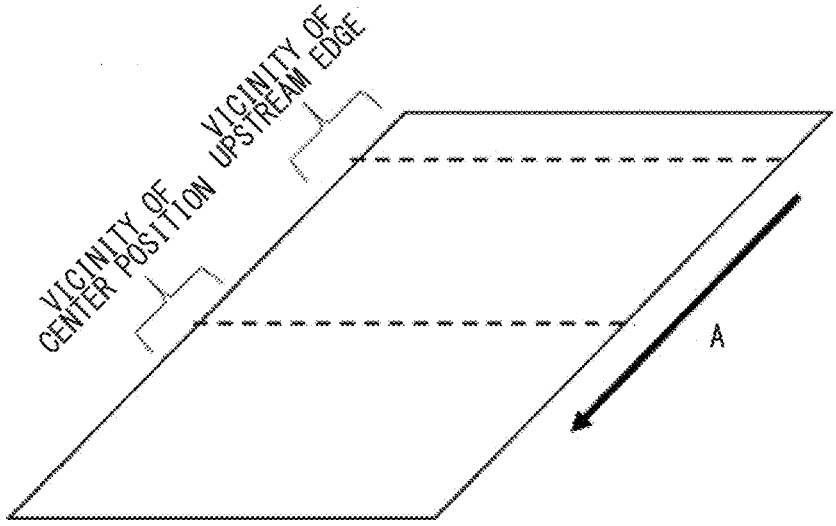
FIG. 6C is a perspective view of a sheet on which a processing, i.e., perforation, has been provided at a vicinity of the center position and at a vicinity of the upstream edge.

FIGS. 6A to C are each a perspective view of a sheet that has been subjected to processing, i.e., perforation, by the sheet processing unit. FIG. 6A illustrates a state in which a perforation has been formed according to a mode, hereinafter referred to as "center perforation", of forming a perforation in a direction, i.e., width direction, orthogonal to the conveyance direction of the sheet at an approximately center position, that is, center portion, of the sheet in the conveyance direction, i.e., length direction, of the sheet denoted by arrow A. FIG. 6B illustrates a state in which a perforation has been formed according to a mode, hereinafter referred to as "single perforation", of forming a perforation in a direction, i.e., width direction, orthogonal to the conveyance direction of the sheet at a vicinity of the upstream edge, i.e., upstream edge portion, which according to the present embodiment is a position 12 mm downstream from the upstream edge of the sheet, in the conveyance direction, i.e., length direction, of the sheet denoted by arrow A. Further, FIG. 6C illustrates a state in which a perforation has been formed according to a mode, hereinafter referred to as "double perforation", of forming two perforations along the width direction of the sheet at two positions, at an approximately center position in the length direction of the sheet along the conveyance direction of the sheet denoted by arrow A, and at a vicinity of the upstream edge, which according to the present embodiment is a position 12 mm downstream from the upstream edge of the sheet.

The sheet subjected to perforation formation processing by the sheet processing unit 220 is nipped and conveyed again by the conveyance roller pair 211, conveyed by the conveyance roller pairs 214 to 216 and the conveyance roller pair 206, and transferred to the finisher 100 disposed downstream.

Multiple types of processing units with different perforation patterns are prepared in the sheet processing unit 220, which are exchangeably disposed. Identification information stored in a storage unit of an IC (Integrated Circuit; semiconductor integrated circuit) chip 221 serving as a storage unit disposed in the sheet processing unit 220 is read by the unit identification sensor 222. Thereby, which type of sheet processing unit 220 is disposed in the processing unit 8 is identified.

Figure 4:
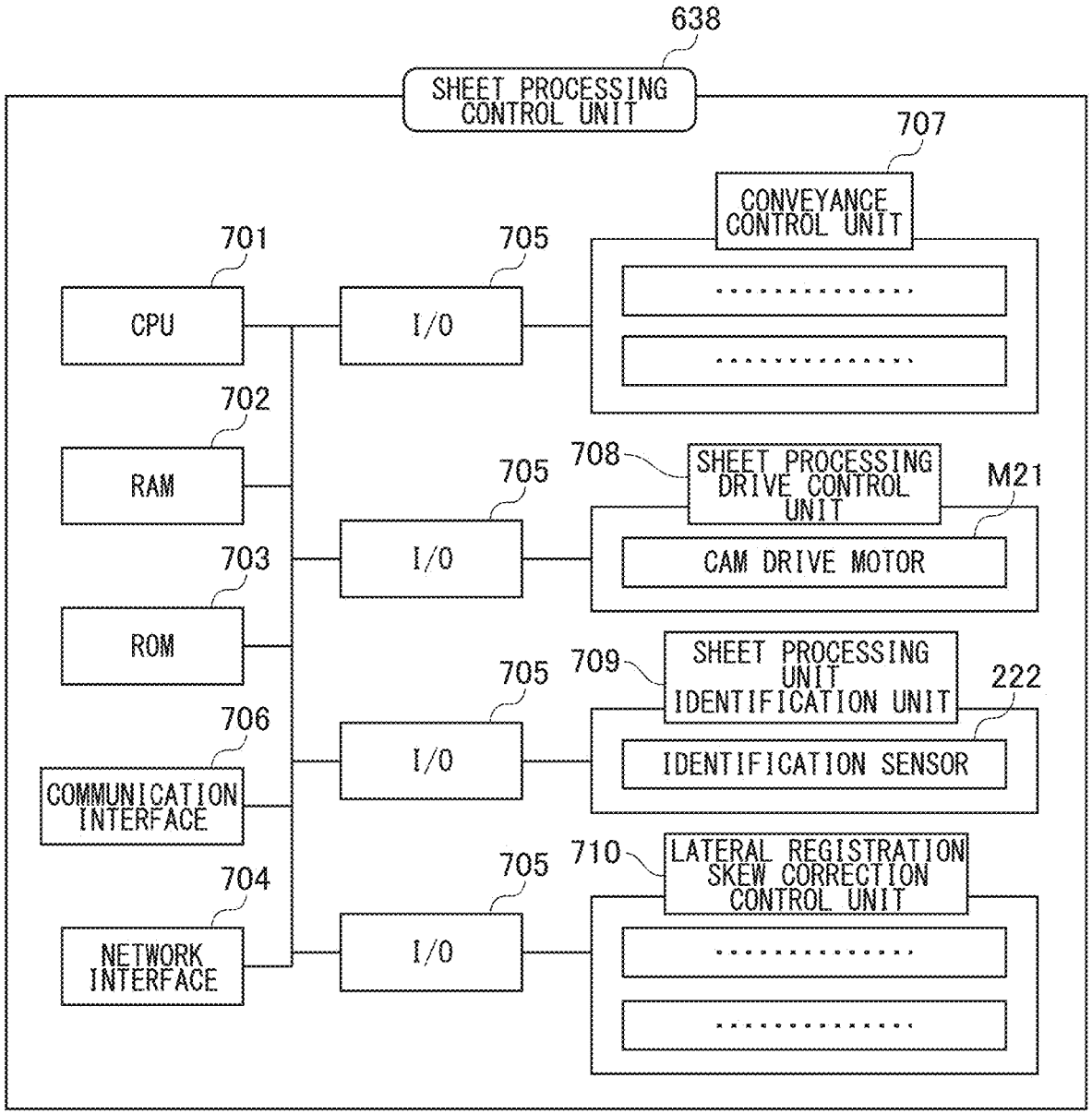
FIG. 4 is a block diagram of a configuration of the control system of the sheet processing apparatus.

As illustrated in FIG. 4, the sheet processing control unit 638 includes a CPU (Central Processing Unit) 701 composed of a microcomputer. It further includes a RAM (Random Access Memory) 702 and a ROM (Read Only Memory) 703. It further includes an I/O (Input/Output) 705 that serves as an input/output unit, a communication interface 706, and a network interface 704. Further, conveyance processing of the sheet is performed in a conveyance control unit 707. Further, the eccentric cam 282 is controlled to be driven in rotation by the cam drive motor M21 in a sheet processing drive control unit 708. In a sheet processing unit identification unit 709, the type of the sheet processing unit 220 being installed is identified by reading the type information stored in the storage unit of the IC chip 221 serving as a storage unit installed in the sheet processing unit 220. Further, skew correction of the sheet is performed in a lateral registration skew correction control unit 710.

Figure 7:
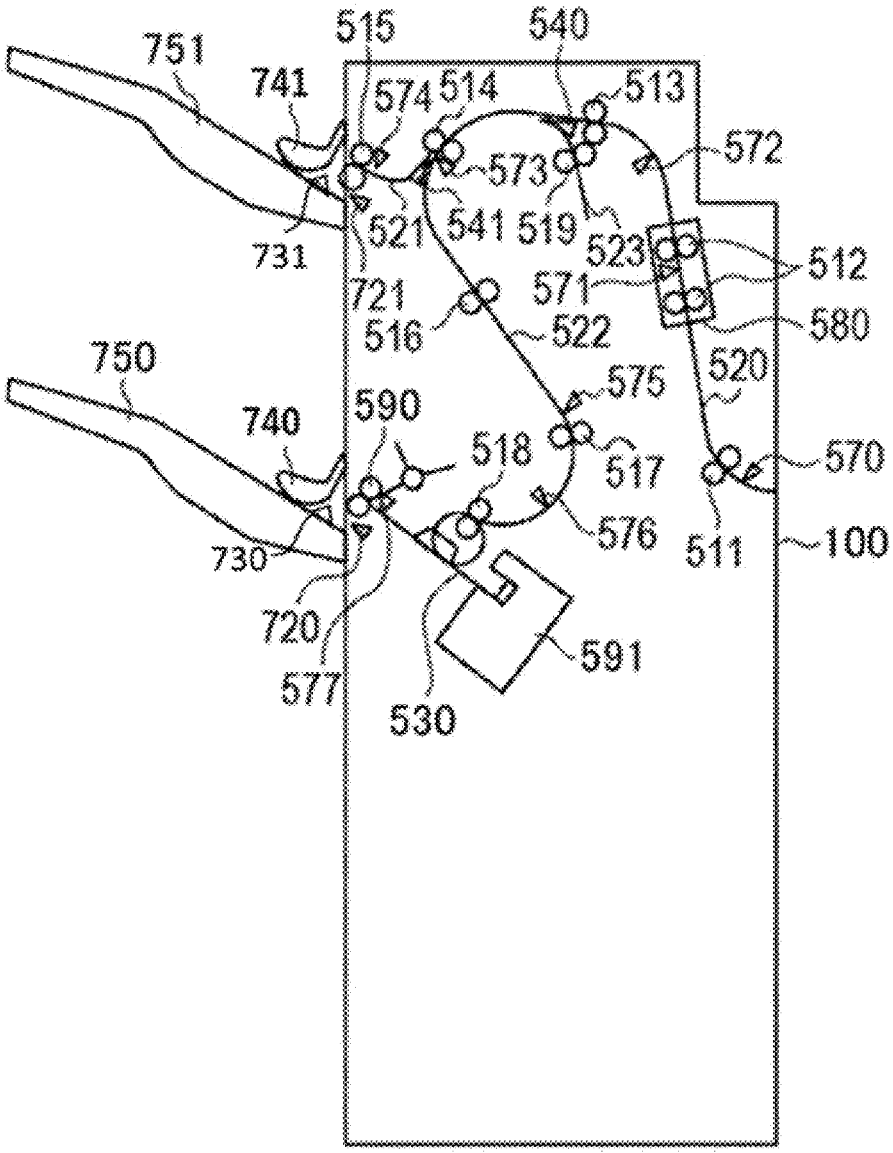
FIG. 7 is a cross-sectional view of a configuration of a finisher.

Next, the configuration of the finisher 100 will be described with reference to FIG. 7. FIG. 7 is a configuration diagram of the finisher 100 illustrated in FIG. 1. The finisher 100 takes in sheets discharged from the sheet processing apparatus 200 sequentially, and performs various sheet post-processing, such as a process of aligning the plurality of sheets being taken in and bundling the sheets into a single bundle, or a stapling process of stapling the trailing edge of the sheet bundle being bundled. The finisher 100 takes in the sheets transferred from the sheet processing apparatus 200 via a conveyance roller pair 511 into a conveyance path 520. The sheet taken in by the conveyance roller pair 511 is conveyed via conveyance roller pairs 512, 513, and 514 serving as conveyance units. Conveyance sensors 570, 571, 572, and 573 are disposed on the conveyance path 520, each of which detects the passing of sheets. The conveyance roller pair 512 is disposed together with the conveyance path sensor 571 in a shift unit 580. The shift unit 580 may move the sheet in the sheet width direction orthogonal to the conveyance direction by a shift motor M11 described below. By driving the shift motor M11 in a state where the conveyance roller pair 512 is nipping the sheet, the sheet may be offset in the sheet width direction while being conveyed. In a shift sort mode, the position of the sheet bundle is shifted per unit in the width direction. The amount of offset may be 15 mm toward a front direction with respect to the center position of the width direction, i.e., front shift, or 15 mm toward a rear direction, i.e., back shift. If there is no shift designation, the sheet is discharged at a same position as the front shift. When it is determined by the input of the conveyance path sensor 571 that the sheet has passed through the shift unit 580, the finisher 100 drives the shift motor M11 and returns the shift unit 580 to the center position.

A switch flapper 540 that guides the sheet that has been reversed and conveyed by the conveyance roller pair 514 to a buffer path 523 is arranged between the conveyance roller pair 513 and the conveyance roller pair 514. The switch flapper 540 is driven by a solenoid not shown. A buffer path roller pair 519 is arranged on the buffer path 523. A switch flapper 541 for switching a conveyance destination to either one of an upper sheet discharge path 521 and a lower sheet discharge path 522 is arranged between the conveyance roller pair 514 and an upper sheet discharge roller pair 515. When the switch flapper 541 is switched to the upper sheet discharge path 521 side, the sheet is guided to the upper sheet discharge path 521 by the conveyance roller pair 514 driven by a conveyance motor M1. Then, the sheet is discharged onto the upper stacking tray 751 by the upper sheet discharge roller pair 515 serving as a discharge unit driven by a sheet discharge motor M2. An upper tray sheet discharge sensor 574 is disposed on the upper sheet discharge path 521, which detects the passing of sheets. When the switch flapper 541 is switched toward the lower sheet discharge path 522 side, the sheet is guided to the lower sheet discharge path 522 by the conveyance roller pair 514 driven by the conveyance motor M1. Then, the sheet is guided by a first lower conveyance roller pair 516, a second lower conveyance roller pair 517, and a processing tray conveyance roller pair 518 driven by the conveyance motor M1 to a processing tray 530. A first conveyance sensor 575 and a second conveyance sensor 576 are disposed on the lower sheet discharge path 522, which detect the passing of sheets.

The sheet guided to the processing tray 530 is discharged onto either the processing tray 530 or the lower stacking tray 750 by a bundle sheet discharge roller pair 590 driven by a bundle sheet discharge motor not shown according to a postprocessing mode. A lower tray sheet discharge sensor 577 is arranged on the processing tray 530, which detects the passing of sheets. Further, a stapler unit 591 is arranged on the processing tray 530, which staples the sheet bundle that has been aligned on the processing tray 530.

The lower stacking tray 750 and the upper stacking tray 751 may be elevated and lowered by a lower tray elevation motor M10 and an upper tray elevation motor M9 described below. An uppermost surface of each stacking tray or the sheets on each stacking tray is detected by a lower tray sheet surface detection sensor 720 and an upper tray sheet surface detection sensor 721. The finisher 100 performs control such that a distance between the uppermost surface of each of the stacking trays or the sheets on each of the stacking trays described above and the sheet discharge port of the sheets maintains a predetermined distance by driving the lower tray elevation motor M10 and the upper tray elevation motor M9 based on the detection results of the lower tray sheet surface detection sensor 720 and the upper tray sheet surface detection sensor 721. Further, an upper tray sheet presence detection sensor 730 and a lower tray sheet presence detection sensor 731 may detect the presence of sheets on the lower stacking tray 750 and the upper stacking tray 751.

Figure 8:
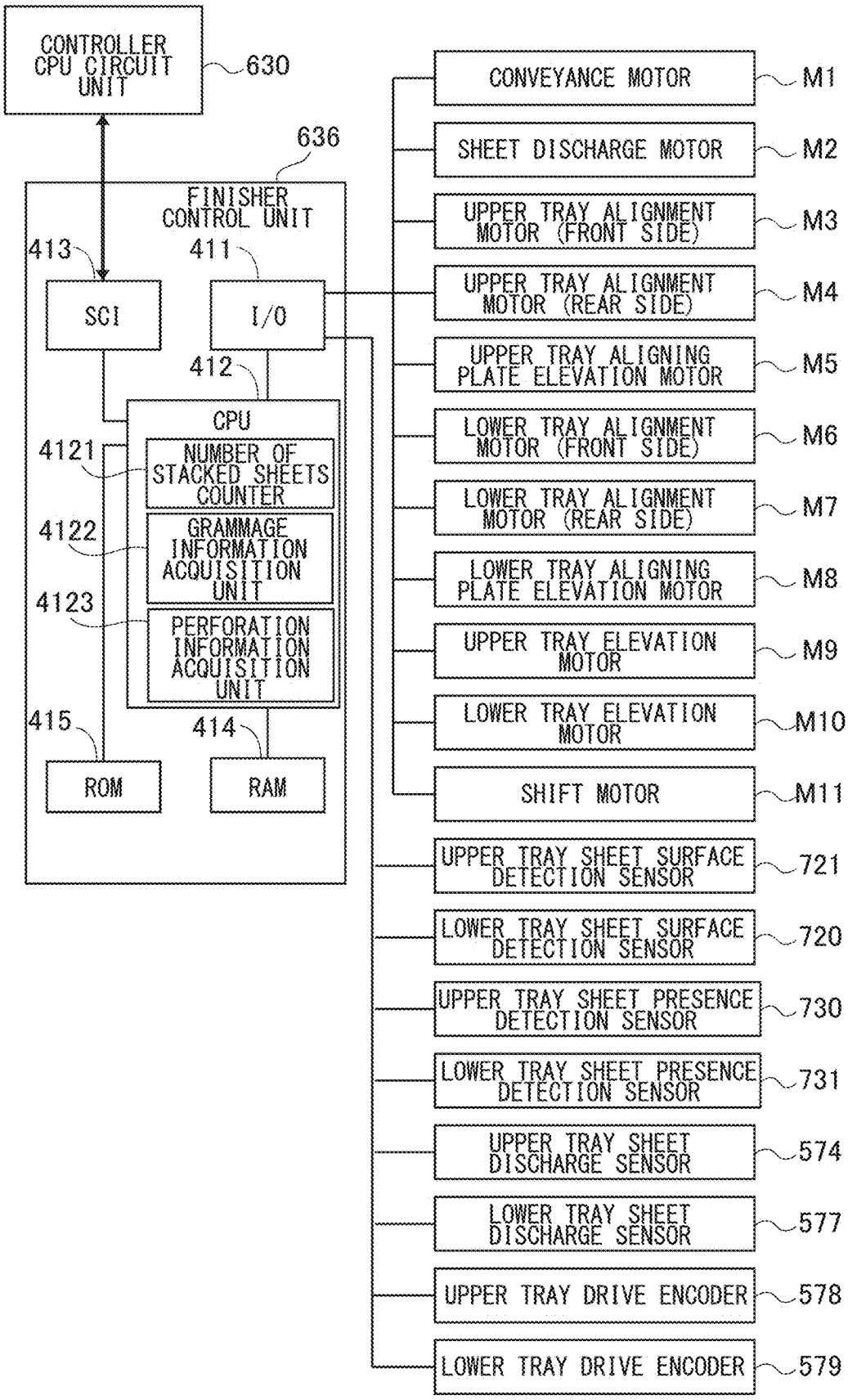
FIG. 8 is a block diagram of a configuration of a control system of the finisher.

Next, a configuration of the finisher control unit 636 will be described with reference to the block diagram of FIG. 8. The finisher control unit 636 serving as a control unit is composed of a CPU 412, a RAM 414, a ROM 415, an input/output I/O 411, and a communication interface (SCI) 413. The finisher control unit 636 communicates with the CPU circuit unit 630 to transmit and receive commands or exchange data such as job information and notice of sheet transfer, and performs drive control of the finisher 100 by executing various programs stored in the ROM 415. In other words, the finisher control unit 636 may be recognized as an information processing apparatus that includes the CPU 412 serving as a processor, and the RAM 414 and the ROM 415 serving as memories, wherein the ROM 415 serving as one example of a non-primary computer-readable storage medium stores a control program for controlling the sheet stacking operation to the finisher 100 serving as a stacking apparatus on which are stacked sheets conveyed from the image forming apparatus 600 without being subjected to the perforation processing by the sheet processing apparatus 200 serving as a perforation apparatus.

The finisher control unit 636 serves as a control unit, i.e., a perforation information acquisition unit 4123 and a grammage information acquisition unit 4122, that receives from the CPU circuit unit 630 postprocessing information, such as information regarding perforation formation processing or information regarding grammage, that the image forming apparatus 600 has received from the operator. The RAM 414 is used for temporarily retaining the control data and as a working area for performing arithmetic operation accompanying control. The communication interface (SCI) 413 performs serial communication with the CPU circuit unit 630 of the image forming apparatus 600, and transfers operations instructions and control data. The input/output I/O 411 transmits on-off signals from the CPU 412 to an output device such as a motor, or transmits signals from input devices such as a sensor to the CPU 412. The conveyance motor M1 and the sheet discharge motor M2 are connected to the input/output I/O 411. A lower tray alignment motor (front side) M6, a lower tray alignment motor (rear side) M7, a lower tray aligning plate elevation motor M8, the upper tray elevation motor M9, the lower tray elevation motor M10, and the shift motor M11 are further connected to the I/O 411. Further, the upper tray sheet surface detection sensor 721, the lower tray sheet surface detection sensor 720, the upper tray sheet presence detection sensor 730, the lower tray sheet presence detection sensor 731, the upper tray sheet discharge sensor 574, and the lower tray sheet discharge sensor 577 are connected to the I/O 411.

Further, an upper tray drive encoder 578 and a lower tray drive encoder 579 are connected to the I/O 411. The upper tray drive encoder 578 and the lower tray drive encoder 579 each output a pulse corresponding to the movement of the lower stacking tray 750 and the upper stacking tray 751 that are elevated and lowered accompanying a sheet surface detection operation of the sheets on each of the lower stacking tray 750 and the upper stacking tray 751. The CPU 412 may detect the moving amount of the lower stacking tray 750 and the upper stacking tray 751 by counting the pulses output from the upper tray drive encoder 578 and the lower tray drive encoder 579.

Figure 9A:
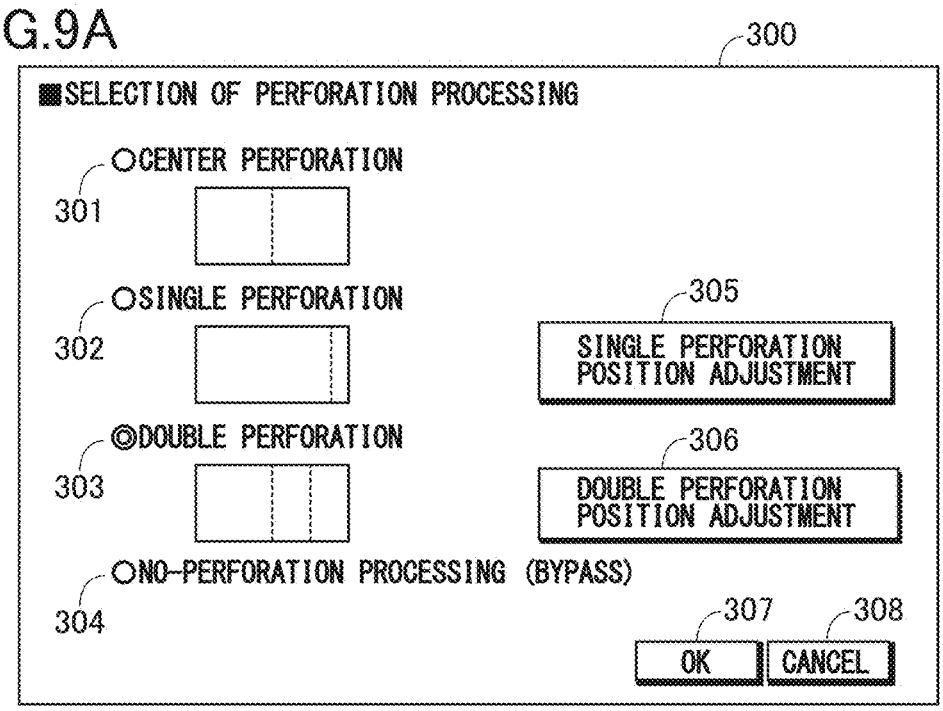
FIG. 9A is a view of a screen for setting a perforation type.
Figure 9B:
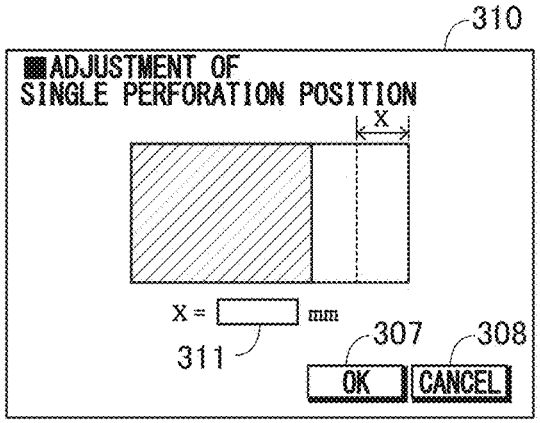
FIG. 9B is a view of a screen for setting a position of a single perforation.
Figure 9C:
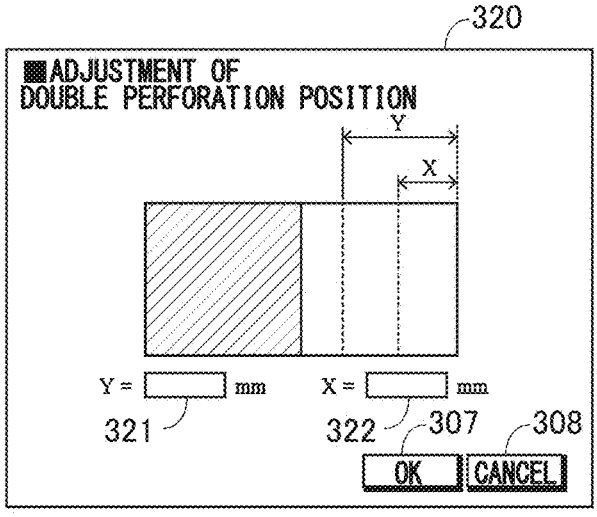
FIG. 9C is a view of a screen for setting a position of a double perforation.

FIGS. 9A to 9C are each a view illustrating one example of an operation screen through which the user may enter perforation types and positions in the operation unit 601. In the image forming system 1, the use may select multiple types of perforation processing, and the positions for forming the perforation may also be adjusted within a prescribed range by the user.

FIG. 9A is a view showing an example of a screen for setting the perforation type. As illustrated in FIG. 9A, a center perforation selection combo box 301, a single perforation selection combo box 302, a double perforation selection combo box 303, and a no-perforation processing (bypass) selection combo box 304 are displayed on the perforation processing selection screen 300. The user may select a perforation type to be executed from these combo boxes.

Further, a single perforation position adjustment button 305 and a double perforation position adjustment button 306 are also displayed on the perforation processing selection screen 300, and by pressing these buttons, a single perforation position adjustment screen 310 illustrated in FIG. 9B or a double perforation position adjustment screen 320 illustrated FIG. 9C are displayed, based on which the positions of the respective perforations may be adjusted.

Further, buttons such as an OK button 307 and a cancel button 308 are also displayed on the perforation processing selection screen 300, but since such buttons are common user interfaces, explanations thereof are omitted.

FIG. 9B is a view illustrating an example of a screen for adjusting the position for forming a single perforation. As illustrated in FIG. 9B, a single perforation X position adjustment field 311, the OK button 307, and the cancel button 308 are displayed on the single perforation position adjustment screen 310. The user may enter a numerical value to the single perforation X position adjustment field 311 through a numerical value input button not shown of the operation unit 601, by which a position for forming the single perforation may be adjusted within a prescribed range.

FIG. 9C is a view illustrating an example of a screen for adjusting the positions for forming a double perforation. As illustrated in FIG. 9C, a double perforation Y position adjustment field 321, a double perforation X position adjustment field 322, the OK button 307, and the cancel button 308 are displayed on the double perforation position adjustment screen 320. The user may enter a numerical value to the double perforation Y position adjustment field 321 and the double perforation X position adjustment field 322 through a numerical value input button not shown of the operation unit 601, by which a position for forming the double perforation may be adjusted within a prescribed range.

Figure 10A:
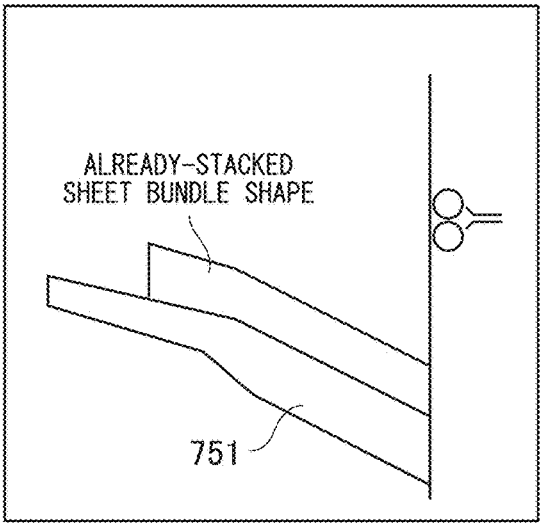
FIG. 10A is a cross-sectional view of a state in which sheets that have not been subjected to perforation processing are stacked on a stacking tray of the finisher.
Figure 10B:
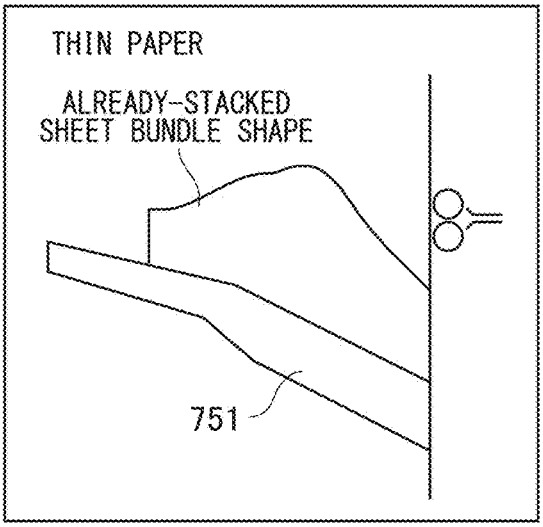
FIG. 10B is a cross-sectional view of a state in which thin papers that have been subjected to perforation processing is stacked on the stacking tray of the finisher.
Figure 10C:
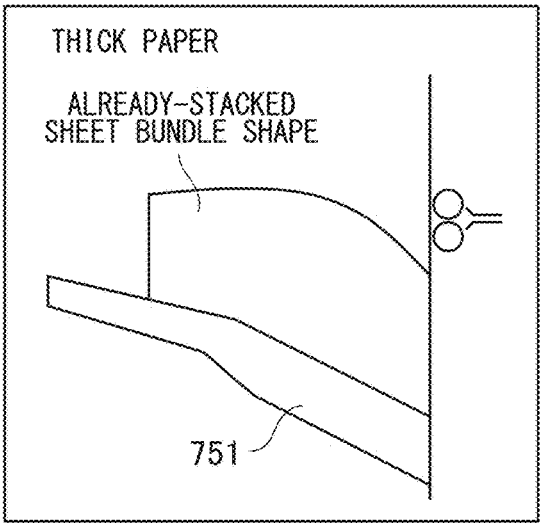
FIG. 10C is a cross-sectional view of a state in which thick papers that have been subjected to perforation processing is stacked on the stacking tray of the finisher.

FIGS. 10A to 10C are views illustrating a state in which the sheets received by the finisher 100 from the sheet processing apparatus 200 are stacked on the upper stacking tray 751. As illustrated in FIG. 10A, if the sheets that are not subjected to perforation processing are stacked in multiple layers, the sheets may be superposed flatly, such that the sheets stacked on the upper stacking tray 751 will be stacked approximately in parallel with an angle of a sheet contact surface of the upper stacking tray 751.

Meanwhile, if perforation processing is performed in the sheet processing apparatus 200, projected portions such as burrs and flash are created at portions where perforation has been formed, such that if a large number of sheets having been subjected to perforation processing are stacked on the upper stacking tray 751, the projected portions will be protruded, and the sheets may not be stacked approximately in parallel on a sheet setting surface of the upper stacking tray 751.

Regarding the influence that projected portions such as burrs and flash caused by the perforation processing has on stacked sheets, sheets having a smaller weight per unit area and a weaker stiffness, i.e., sheets having a grammage of 100 g/m$^2$ or less, hereinafter referred to as "thin paper", is more influenced than sheets having a greater weight per unit area and a stronger stiffness, i.e., sheets having a grammage of over 100 g/m$^2$, hereinafter referred to as "thick paper". The heights of the projected portions such as burrs and flash are not so different between thick paper and thin paper, so the above-mentioned difference is caused by thin paper having a higher deformation rate conforming to the shapes of the already stacked sheets due to the small thickness of the sheets themselves, by not being able to crush the burrs due to the sheets being light in weight, and by having a weak sheet stiffness, i.e., having a lower rigidity. As a result, the already-stacked sheet bundle will be warped greatly even by a smaller number of stacked sheets of thick paper compared to thick paper. FIG. 10B is a view illustrating a shape of a sheet bundle that has been already stacked in a case where 300 sheets of thin paper having a center perforation provided thereon are continuously stacked onto the upper stacking tray 751, and FIG. 10C is a view illustrating a shape of a sheet bundle that has already been stacked in a case where 300 sheets of thick paper having a center perforation provided thereon are continuously stacked onto the upper stacking tray 751, wherein protrusion becomes greater in FIG. 10B than FIG. 10C, and sheets tend to fall off.

In the finisher 100, normally, the upper limit number of sheets stackable on the lower stacking tray 750 or the upper stacking tray 751 is set to a maximum number of stackable sheets, i.e., maximum stackable amount, of the tray on which the sheets are to be stacked, which according to the present embodiment is 4000 sheets. When the number of stacked sheets reaches the upper limit number, the finisher control unit 636 outputs a signal for notifying overload, which refers to a state where no more sheets may be stacked on the tray of the image forming apparatus 600, hereinafter referred to as "fully loaded state", to the image forming apparatus 600. When an overload notice is received from the finisher 100, the image forming apparatus 600 stops the printing processing temporarily, and operates to wait for the sheet bundle to be removed from the lower stacking tray 750 or the upper stacking tray 751. Even in a case where sheets having been subjected to perforation are stacked, if a similar upper limit number of stacked sheets (4000 sheets) are set, the projected portions may protrude as described above according to conditions such as the shape or angle of the tray on which the sheets are stacked, and when successive sheets are stacked, stacking failure or falling of successive sheets may occur. The upper tray sheet surface detection sensor 721 and the lower tray sheet surface detection sensor 720 described above may detect the sheet surface of each tray, and lower the tray by driving a tray elevation motor to maintain a fixed paper surface height, wherein a fully loaded state may be set when the lowering limit the tray is reached.

Therefore, an upper limit number of stacked sheets in a case where sheets having been subjected to perforation are stacked may be varied according to the position on which perforation has been provided, and set to an appropriate number of sheets, such that stacking failure of sheets and falling of sheets may be prevented.

Setting of Upper Limit of Number of Stacked Sheets

Since the stackability of sheets on the stacking tray differs according to the perforation mode described above and the sheet grammage, the relationship between the perforation mode and the setting of the upper limit number of stacked sheets will be described with reference to FIG. 11.

Figure 11:
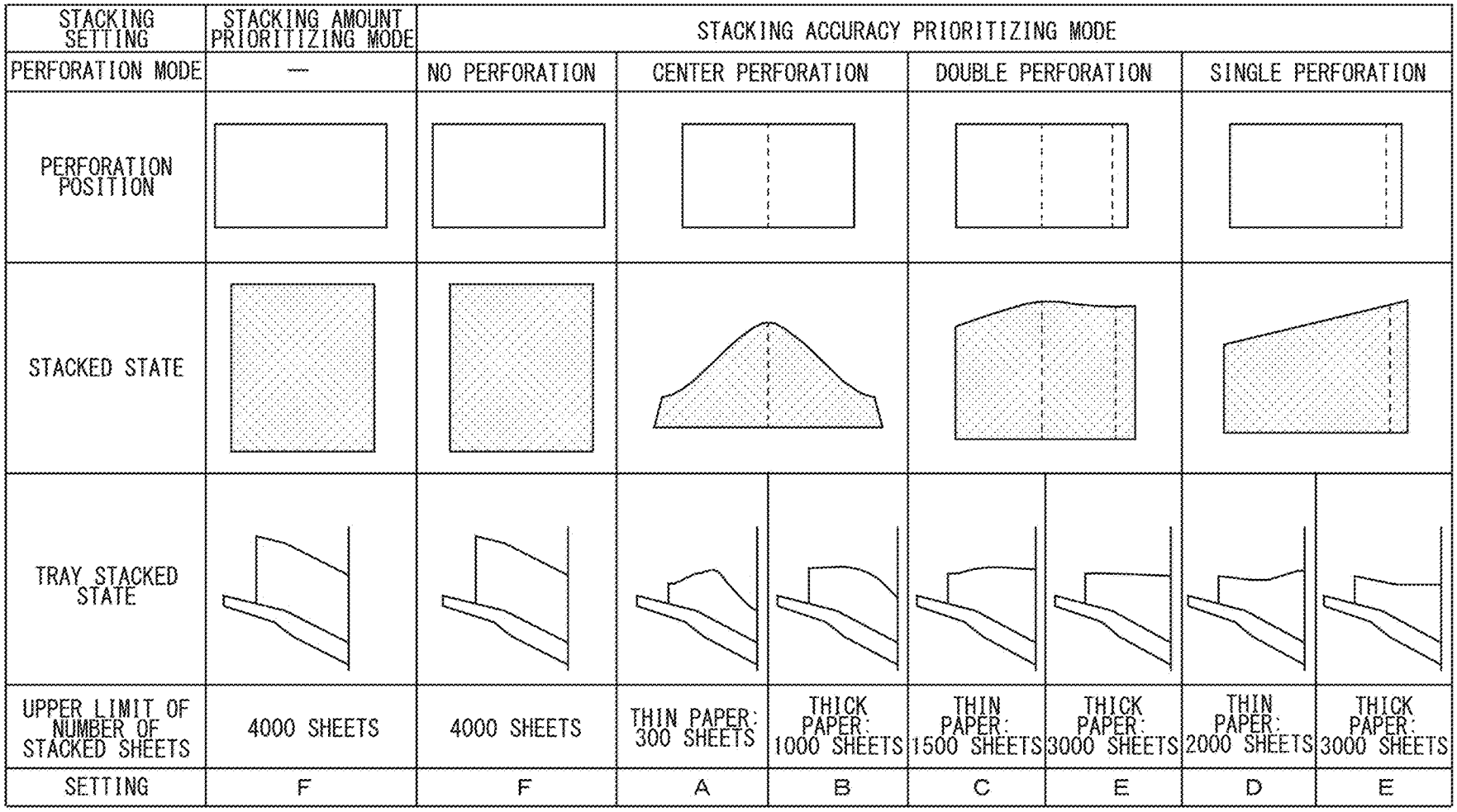
FIG. 11 is an explanatory view of an upper limit of number of stacked sheets according to perforation modes.

As illustrated in FIG. 11, in a case where perforation is not performed, i.e., no perforation, the upper limit number of stacked sheets is set to 4000 sheets, i.e., maximum number of stackable sheets. Whereas, in a case where the perforation mode is a center perforation, the vicinity of a center position of the sheets will be protruded compared to other portions due to the influence of burrs and flash, such that when successive sheets are stacked, the sheets may fall downstream in the conveyance direction along the shape of the stacked sheet bundle. Therefore, in the case of a thin paper being greatly influenced by burrs and flash, 300 is set as the upper limit number of stacked sheets, and in the case of a thick paper that has a smaller influence of burrs, 1000 is set as the upper limit number of stacked sheets. Further, in a case where the perforation mode is a double perforation, the vicinity of the center position of the sheet and the vicinity of the upstream edge are protruded compared to other portions. In that case, not only one portion will be extremely warped, such that the stackable number of sheets may be increased than in the case of the center perforation. In this example, 1500 is set as the upper limit number of stacked sheets in the case of thin paper, and 3000 is set as the upper limit of number of stacked sheets in the case of thick paper. Further, in the case of single perforation, the vicinity of the upstream edge of the sheet will be protruded compared to other portions. The present embodiment is described based on a system for discharging sheets to a finisher, and the lower stacking tray 750 and the upper stacking tray 751 will have an inclination angle of trays as illustrated in FIG. 7 and FIGS. 10A to 10C, such that when only the vicinity of the upstream edge of the sheet is raised, the sheets may have a lower possibility of falling downstream in the conveyance direction compared to the center perforation or the double perforation. Therefore, in the present example, 2000 is set as the upper limit number of stacked sheets in the case of thin paper, and 3000 is set as the upper limit number of stacked sheets in the case of thick paper.

That is, in the present embodiment, if a predetermined sheet, i.e., sheet of a predetermined sheet type, grammage, and size; for example, a normal paper, A3 size, having a grammage of 70 g/m$^2$, not subjected to perforation is stacked on the stacking tray, the finisher control unit 636 stops stacking operation of sheets on the stacking tray according to a state where a first amount of sheets, i.e., first upper limit number of stacked sheets, such as 4000 sheets described above, have been stacked on the stacking tray. Further, if a predetermined sheet, i.e., sheet of a predetermined sheet type, grammage, and size; for example, a normal paper, A3 size, having a grammage of 70 g/m$^2$, subjected to perforation is stacked on the stacking tray, the finisher control unit 636 stops stacking operation of sheets on the stacking tray according to a state where a predetermined number of sheets of an amount smaller than the first amount, i.e., smaller number of sheets than the first amount, such as 3000, 2000, 1500, 1000, or 300 as described above, has been stacked on the stacking tray.

The finisher 100 is a sheet stacking apparatus on which are stacked sheets transmitted from the apparatus on the upstream side in the sheet conveyance direction, which according to the present embodiment are the image forming apparatus 600 and the sheet processing apparatus 200, and includes the conveyance roller pairs 512, 513, and 514 serving as conveyance units for conveying sheets transmitted from the apparatus disposed upstream, the upper sheet discharge roller pair 515 serving as a discharge unit for discharging sheets conveyed by the conveyance unit, a stacking unit for stacking sheets discharged from the discharge unit, and the finisher control unit 636 serving as a control unit for controlling the discharge unit by acquiring a perforation presence information of the sheets stacked on the stacking unit from the upstream side apparatus and varying the upper limit number of stacked sheets stacked on the stacking unit. If predetermined sheets recognized as having a predetermined perforation are stacked on the stacking unit, the finisher control unit 636 controls the discharge unit to stop the stacking of sheets to the stacking unit based on a number of stacked sheets smaller than the upper limit number of stacked sheets of the predetermined sheets which are recognized to have no predetermined perforation.

Further, in a case where a predetermined sheet, i.e., sheet of a predetermined sheet type, grammage, and size; for example, a normal paper, A3 size, having a grammage of 70 g/m$^2$, having a perforation provided on a first position, such as an upstream edge portion, is stacked on the stacking tray, the finisher control unit 636 stops stacking operation of sheets on the stacking tray according to a state where a second amount of sheets, i.e., first upper limit number of stacked sheets, such as 3000 in the case of thick paper and 2000 in the case of thin paper, smaller than the first amount have been stacked on the stacking tray. Further, if a predetermined sheet, i.e., sheet of a predetermined sheet type, grammage, and size; for example, a normal paper, A3 size, having a grammage of 70 g/m$^2$, having a perforation provided on a second position, such as a center portion, that differs from the first position is stacked on the stacking tray, the finisher control unit 636 stops stacking operation of sheets on the stacking tray according to a state where a third amount of sheets smaller than the second amount, i.e., third upper limit number of stacked sheets, such as 1000 in the case of thick paper and 300 in the case of thin paper, have been stacked on the stacking tray.

That is, in other words, the finisher control unit 636 makes the CPU 412 acquire the position information of perforation on the predetermined sheet subjected to perforation processing stacked on the stacking apparatus. In a state where the acquired perforation position is approximately the center in the sheet conveyance direction, the CPU 412 stops the stacking of sheets to a stacking unit based on a number of stacked sheets smaller than the upper limit number of stacked sheets of a case where the position of perforation of the predetermined sheet is near the trailing edge in the sheet conveyance direction.

Further, if a sheet of a first grammage, such as thick paper, A3 size, having a grammage exceeding 100 g/m$^2$, having a perforation provided on a specific position, by a same mode, same position, and same number, is stacked on the stacking tray, the finisher control unit 636 stops stacking operation of sheets on the stacking tray according to a state where a fourth amount of sheets, i.e., fourth upper limit number of stacked sheets, such as 3000 and 1000, smaller than the first amount have been stacked on the stacking tray. Further, if a sheet having a second grammage that is smaller than the first grammage, such as thin paper, A3 size, having a grammage of 100 g/m$^2$ or less, having a perforation provided on the specific position is stacked on the stacking tray, the finisher control unit 636 stops stacking operation of sheets on the stacking tray according to a state where a fifth amount of sheets smaller than the fourth amount, i.e., fifth upper limit number of stacked sheets, such as 2000, 1500, 300, have been stacked on the stacking tray.

In other words, the finisher control unit 636 makes the CPU 412 acquire the grammage information of sheets subjected to perforation processing stacked on the stacking apparatus by the CPU 412. In a state where the grammage of the predetermined sized sheet subjected to perforation processing being acquired is smaller than a predetermined value, the CPU 412 stops the stacking of sheets on a stacking apparatus based on a number of stacked sheets smaller than the upper limit number of stacked sheets, specifically, the upper limit number of stacked sheets to the stacking tray, of a case where the grammage of the predetermined sized sheet is greater than a predetermined value.

Further, in a state where sheets subjected to perforation are stacked on the stacking tray, the finisher control unit 636 varies the amount of sheets based on which the stacking operation of sheets on the stacking tray is stopped according to the number of lines of perforation applied to the sheets being stacked on the stacking tray. For example, when a double perforation and a center perforation are compared, the upper limit number of stacked sheets is 3000 sheets for thick paper and 1500 sheets for thin paper in the case of double perforation, whereas the upper limit thereof is 1000 sheets for thick paper and 300 sheets for thin paper in the case of center perforation.

That is, in other words, the finisher control unit 636 makes the CPU 412 acquire the number information of the lines of perforation of the sheets stacked on the stacking apparatus. In a state where the number of lines of perforation of the predetermined sheet being acquired is one, the CPU 412 stops the stacking of sheets on the stacking apparatus based on a number of stacked sheets smaller than the upper limit number of stacked sheets of a case where multiple perforation is applied to the predetermined sheet.

Further according to the present embodiment, a stacking setting capable of selecting whether to prioritize the stacking amount of sheets stacked on the lower stacking tray 750 or the upper stacking tray 751, or to prioritize the stacking accuracy thereof is provided. The setting may be set through the operation unit 601. That is, the finisher control unit 636 is configured to enable execution of a stacking amount prioritizing mode and a stacking accuracy prioritizing mode. In the stacking setting, in a case where a stacking amount prioritizing mode, i.e., second mode, is selected, the upper limit number of stacked sheets of 4000 sheets, i.e., maximum number of stackable sheets, is set regardless of the presence and absence of perforation. In a case where a stacking accuracy prioritizing mode, i.e., first mode, is set, the upper limit number of stacked sheets is set according to the perforation mode and the grammage of the sheet, as described above.

The upper limit number of stacked sheets described here is the upper limit number assumed to be stacked on the lower stacking tray 750 or the upper stacking tray 751 of the finisher 100 according to the present embodiment, and it is preferable to set an appropriate upper limit number according to the executing conditions, such as the shape or angle of the stacking tray. The present embodiment has been described based on a stacking tray shape having an inclination angle that is lowered toward the upstream side in the conveyance direction, but even in the case of an approximately horizontal tray shape without an inclination angle, the aligning property of the sheet subjected to perforation may be improved by executing the present invention.

Figure 12:
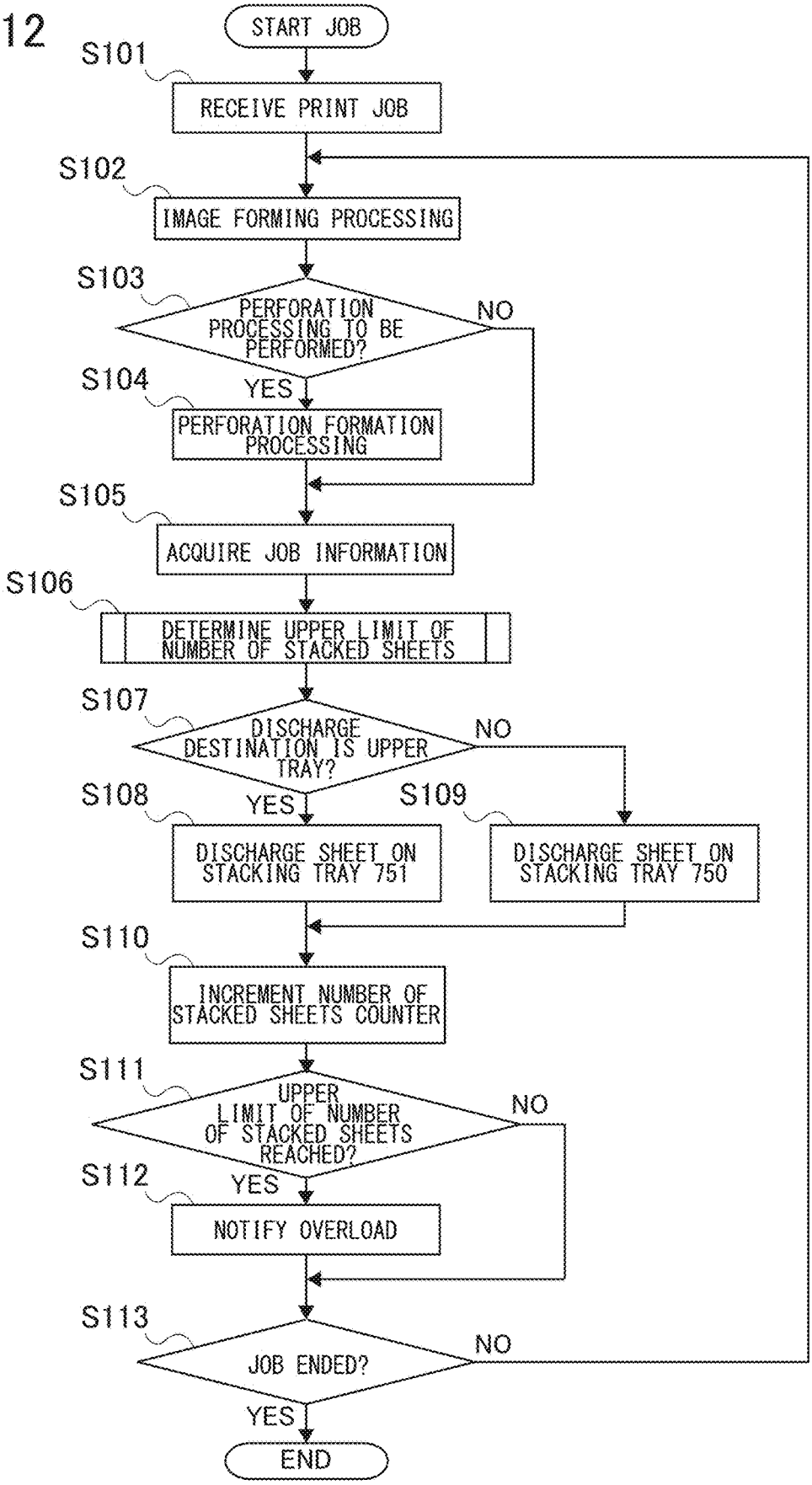
FIG. 12 is a flowchart of a flow of printing processing.

Now, a flow of the printing processing executed in the image forming system 1 from transferring of the sheets to which image has been formed in the image forming apparatus 600 to the sheet processing apparatus 200, providing perforation to the transferred sheet in the sheet processing apparatus 200, discharging the sheet subjected to perforation to the finisher 100, and discharging the sheet by the finisher 100 to the upper stacking tray 751 or the lower stacking tray 750 to completing stacking, will be described with reference to the flowchart of FIG. 12.

The printing processing is realized by the CPU 629 of the CPU circuit unit 630 reading and executing the program stored in the ROM 631 to the RAM 655 as needed in the image forming apparatus 600, the CPU 701 of the sheet processing control unit 638 reading and executing the program stored in the ROM 702 to the RAM 703 as needed in the sheet processing apparatus 200, and the CPU 412 of the finisher control unit 636 reading and executing the program stored in the ROM 415 to the RAM 414 as needed in the finisher 100.

In FIG. 12, in a state where a printing processing (job) is started, the CPU 629 of the image forming apparatus 600 receives a print job that has been entered (step S101).

After receiving the print job, the CPU 629 of the image forming apparatus 600 feeds the sheet corresponding to the received print job information from the sheet cassettes 909*a* and 909*b* to an image forming unit not shown, forms an image on a sheet by the image forming unit (step S102), and discharges the sheet on which an image has been formed to the sheet processing apparatus 200.

In a state where the sheet discharged from the image forming apparatus 600 is received by the sheet processing apparatus 200, the CPU 701 of the sheet processing apparatus 200 recognizes whether the received sheet is a sheet on which the perforation formation processing is to be performed based on the print job information (step S103).

If it is recognized in step S103 that the received sheet is not a sheet to be subjected to perforation formation processing (step S103: NO), the CPU 701 of the sheet processing apparatus 200 discharges the sheet to the finisher 100 without performing the perforation formation processing.

Meanwhile, if it is recognized in step S103 that the received sheet is a sheet to be subjected to perforation formation processing (step S103: YES), the CPU 701 of the sheet processing apparatus 200 performs a perforation formation processing (step S104), and discharges the sheet to the finisher 100.

The CPU 412 of the finisher control unit 636 acquires the entered print job information (step S105), and determines the upper limit number of stacked sheets that may be stacked on the lower stacking tray 750 or the upper stacking tray 751 based on the acquired information (step S106). The method for determining the upper limit number of stacked sheets will be described in detail below.

Thereafter, the CPU 412 determines whether the discharge destination tray of the received sheet is the upper stacking tray 751 or the lower stacking tray 750 (step S107).

If it is determined in step S107 that the discharge destination tray is the upper stacking tray 751 (step S107: YES), the CPU 412 conveys the sheet along the upper sheet discharge path 521 and discharges the sheet on the upper stacking tray 751 (step S108).

Meanwhile, if it is determined in step S107 that the discharge destination tray is the lower stacking tray 750 (step S107: NO), the CPU 412 conveys the sheet along the lower sheet discharge path 522 and discharges the sheet on the lower stacking tray 750 (step S109).

When the discharging of the sheet to the lower stacking tray 750 or the upper stacking tray 751 is completed, the CPU 412 increments the counter of number of stacked sheets of each tray (step S110). In this state, a number of stacked sheets counter being incremented is not limited to a total sheet counter that counts the total number of sheets stacked on the lower stacking tray 750 or the upper stacking tray 751, but also to a perforation sheet counter that counts only the number of sheets subjected to perforation processing, or both the above counters may be provided to count the sheets.

After incrementing the number of stacked sheets counter, the CPU 412 determines whether the number of stacked sheets counter has reached the upper limit number of stacked sheets determined in step S106 (step S111).

If it is determined in step S111 that the number of sheets stacked on the lower stacking tray 750 or the upper stacking tray 751 has reached the upper limit number of stacked sheets (step S111: YES), the CPU 412 notifies the image forming apparatus 600 that either the lower stacking tray 750 or the upper stacking tray 751 is overloaded (step S112).

The image forming apparatus 600 continues the operation from the point of time when a notice of overload of the number of stacked sheets has been received until the fed sheet has been stacked on the stacking tray, and thereafter, temporarily stops the image formation processing. When sheets of paper on the lower stacking tray 750 or the upper stacking tray 751 are removed and the CPU 412 recognizes that the sheet presence detection sensor 730 or 731 has become OFF, the fully loaded state is cancelled.

Meanwhile, if it is determined in step S111 that the number of sheets stacked on the lower stacking tray 750 or the upper stacking tray 751 has not reached the upper limit number of stacked sheets (step S111: NO), the CPU 412 advances to step S113 without notifying the image forming apparatus 600 that the number of stacked sheets on the lower stacking tray 750 or the upper stacking tray 751 of the finisher 100 has reached an overloaded state.

The CPU 412 determines whether the job for all pages has been completed (step S113). If it is determined in step S113 that the job for all pages is not completed (step S113: NO), the CPU 412 returns to step S102 and continues the processing to perform the processing of the subsequent job.

Meanwhile, if it is determined in step S113 that the job for all pages has been completed (step S113: YES), the printing processing is ended.

As described, according to the present embodiment, at a point of time when the number of stacked sheets being stacked on the lower stacking tray 750 or the upper stacking tray 751 has reached the upper limit number of stacked sheets, overload is notified. Thereby, including the case where sheets subjected to perforation are stacked, output of sheets is stopped temporarily at a most appropriate number of stacked sheets according to the sheets being stacked, such that occurrence of stacking failure and falling of sheets described above may be prevented.

In the present embodiment, overload, that is, whether the sheets stacked on the stacking tray have reached the upper limit number of stacked sheets or more, has been determined based on a count value of a number of stacked sheets counter 4121 that counts the number of sheets being discharged onto the stacking tray, but for example, it may also be determined based on the information of the number of sheets being output counted by a counter of the CPU circuit unit 630 of the image forming apparatus 600 or based on the information of the number of sheets being received counted by a receiving counter of the finisher control unit 636. Further, the number of sheets may not be counted, and instead, control may be performed to use a height information of the lower stacking tray 750 or the upper stacking tray 751 and notify overload if the height has reached a certain reference height, or to provide a sensor for detecting the sheet height stacked on the lower stacking tray 750 or the upper stacking tray 751 and determining whether the sheets has reached the upper limit number of stacked sheets based on the detection result of the sensor. That is, the finisher control unit 636 is configured to stop the stacking operation of sheets on the stacking tray 750/751 according to the amount of sheets stacked on the stacking tray 750/751 serving as stacking units. The amount of sheets stacked on the stacking tray 750/751 may be detected based on the count value being counted by various counters as described above or on the output value of various sensors.

The number of sheets subjected to perforation that may be stacked is recognized in advance when the image forming apparatus 600 receives a job, such that if the scheduled number of sheets to be stacked is equal to or greater than the upper limit number of stacked sheets, for example, it may be possible to display a message on a screen notifying that the stacking of sheets is stopped once when the upper limit number of stacked sheets has been reached on a display of the operation unit 601 or the personal computer 620, or to have the sheets exceeding the upper limit number stacked on another stacking tray.

In the present embodiment, whether to perform the perforation formation processing is determined in step S103, but it is also possible to determine the same by the perforation information acquisition unit 4123 acquiring information stating that perforation has initially been performed to the sheet fed to the image forming apparatus 600 (hereinafter referred to as pre-perforated sheet) from the image forming apparatus 600. Meanwhile, in a case where the pre-perforated sheet has only a small burr and small protrusion in the height direction, it may be possible to allow a user setting to not limit the maximum stackable amount even in a case where the sheets have perforations.

Determination Processing of Upper Limit of Number of Stacked Sheets

Now, a method for determining the upper limit number of stacked sheets for determining overload of the number of stacked sheets in the finisher 100 will be described with reference to FIG. 13.

Figure 13:
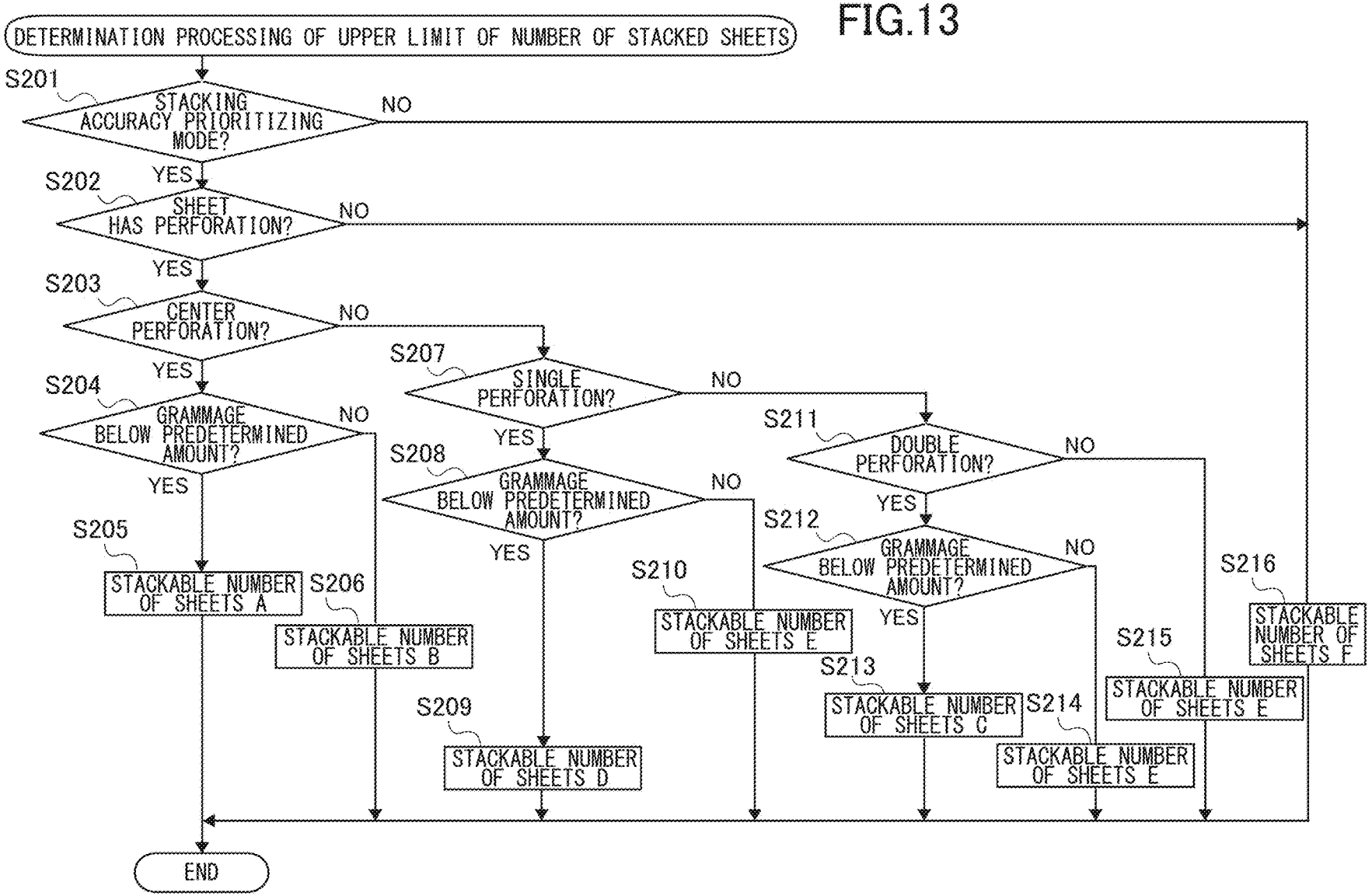
FIG. 13 is a flowchart of a flow of a determination processing of an upper limit number of stacked sheets.

FIG. 13 is a flowchart showing the process for determining the upper limit number of stacked sheets based on the acquired job information. The present flowchart is executed by the CPU 412 of the finisher control unit 636.

When the determination processing of the upper limit number of stacked sheets is executed, at first, the CPU 412 determines whether the stacking accuracy prioritizing mode has been selected in the stacking setting of the finisher 100 (step S201).

If it is determined in step S201 that the stacking accuracy prioritizing mode has not been selected (step S201: NO), the CPU 412 sets the upper limit number of stacked sheets to F (step S216). Since the upper limit number of stacked sheets F is in a non-limited state, the upper limit number of stacked sheets F is the maximum number of stackable sheets of the finisher 100.

Meanwhile, if it is determined in step S201 that stacking accuracy prioritization has been selected (step S201: YES), the CPU 412 determines whether perforation processing has been performed to the stacked sheet based on the acquired job information (step S202).

If it is determined in step S202 that perforation processing is not performed to the sheets (step S202: NO), the CPU 412 sets the upper limit number of stacked sheets to F (step S216). The upper limit number of stacked sheets in a state where perforation is not provided on the sheet is set to the upper limit number of stacked sheets F according to the present embodiment, but it may also be set arbitrarily according to processing other than perforation or grammage information of the sheet.

If it is determined in step S202 that perforation processing has been performed to the sheet (step S202: YES), the CPU 412 determines whether the perforation mode provided on the stacked sheets is a center perforation based on the acquired job information (step S203).

If it is determined in step S203 that the perforation mode is a center perforation (step S203: YES), the CPU 412 determines whether the grammage of the sheet being stacked is less than a predetermined amount (step S204). This is because, as described above, thin paper is more likely to be affected by burrs and flash of perforation, and the already stacked sheet bundle is warped greatly.

If it is determined in step S204 that the grammage of the sheet being stacked is less than a predetermined amount (step S204: YES), the CPU 412 sets the upper limit number of stacked sheets of the lower stacking tray 750 or the upper stacking tray 751 to A (step S205).

Meanwhile, if it is determined that the grammage of the sheet being stacked is equal to or greater than a predetermined amount (step S204: NO), the CPU 412 sets the upper limit number of stacked sheets of the lower stacking tray 750 or the upper stacking tray 751 to B (step S206).

If it is determined in step S203 that the perforation mode is not a center perforation (step S203: NO), the CPU 412 further determines whether the perforation mode is a single perforation (step S207).

If it is determined in step S207 that the perforation mode is a single perforation (step S207: YES), the CPU 412 determines whether the grammage of the sheet being stacked is less than a predetermined amount (step S208).

If it is determined in step S208 that the grammage of the sheet being stacked is less than a predetermined amount (step S208: YES), the CPU 412 sets the upper limit number of stacked sheets of the lower stacking tray 750 or the upper stacking tray 751 to D (step S209).

Meanwhile, if it is determined that the grammage of the sheet being stacked is equal to or greater than a predetermined amount (step S208: NO), the CPU 412 sets the upper limit number of stacked sheets of the lower stacking tray 750 or the upper stacking tray 751 to E (step S210).

Meanwhile, if it is determined in step S207 that the perforation mode is not a single perforation (step S207: NO), the CPU 412 determines whether the perforation mode is a double perforation (step S211).

If it is determined in step S211 that the perforation mode is a double perforation (step S211: YES), the CPU 412 determines whether the grammage of the sheet being stacked is less than a predetermined amount (step S212).

If it is determined in step S212 that the grammage of the sheet being stacked is less than the predetermined amount (step S212: YES), the CPU 412 sets the upper limit number of stacked sheets of the lower stacking tray 750 or the upper stacking tray 751 to C (step S213).

Meanwhile, if it is determined that the grammage of the sheet being stacked is equal to or greater than a predetermined amount (step S212: NO), the CPU 412 sets the upper limit number of stacked sheets of the lower stacking tray 750 or the upper stacking tray 751 to E (step S214).

Further, if it is determined in step S211 that the perforation mode is not a double perforation (step S211: NO), the CPU 412 determines that the perforation mode is other than the prescribed mode, and sets the upper limit number of stacked sheets of the lower stacking tray 750 or the upper stacking tray 751 to E (step S215).

What is meant by other than the prescribed mode is that the mode provides perforation to a conveyance direction of the sheet or the mode provides a perforation processing to only one portion of the sheet. Even according to such cases, the upper limit number of stacked sheets may be set arbitrarily according to stackability. Meanwhile, in a case where perforation processing is performed to only a small portion of the sheet, such as to one portion of a corner of the sheet, the height will not be greatly varied, such that the upper limit number of stacked sheets may not be changed.

The operations described above in the present embodiment may be realized by having the program stored in either the CPU installed in the image forming apparatus 600 or the CPU installed in the sheet processing apparatus 200. Further, the operations may be realized by various methods, such a method for reading a control program from an external server or a cloud online, or by reading and executing the program from a personal computer for operating the image forming system.

As described above, according to the present embodiment, in a case where a large number of sheets to which perforation is applied is stacked, the upper limit number of stacked sheets on the stacking tray may be set to a most suitable number of stacked sheets according to the perforation mode applied to the sheet or to the grammage of the sheet, and since the number of sheets to be stacked on the stacking tray is limited, stacking failure or the falling of successive sheets from the tray may be prevented even in a case where sheets provided with perforation are stacked.

According to the embodiment, an aligning property of stacked sheets may be improved in the sheet stacking apparatus for stacking sheets on which perforations are formed.

The present invention is not limited to the embodiments described above, and various modifications are enabled with the scope of the present invention, wherein all technical matter included in the technical ideas disclosed in the claims may be the object of the present invention. The embodiments described above have illustrated preferable examples, but those with ordinary skill in the field of art may implement various alternative examples, modified examples, deformation examples, and improvement examples based on the contents disclosed in the present specification, all of which may be included in the technical field disclosed in the following claims.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

The present invention may be applied to sheet stacking apparatuses for stacking sheets.

The invention claimed is:

1. A sheet stacking apparatus comprising:

a conveyance mechanism configured to convey a sheet in a predetermined conveyance direction;

a stacking tray configured to stack the sheet conveyed by the conveyance mechanism; and a controller configured to stop a stacking operation of the sheet on the stacking tray based on a number of predetermined sheets stacked on the stacking tray, wherein the number of the predetermined sheets in a case where each of the predetermined sheets has a perforation thereon is less than the number of the predetermined sheets in a case where each of the predetermined sheets has no perforation thereon.

2. The sheet stacking apparatus according to claim 1, wherein the controller controls the stacking tray such that the number of predetermined sheets in a case where each predetermined sheet has the perforation at a first position is less than the number of predetermined sheets in a case where each predetermined sheet has the perforation at a second position nearer an edge of the predetermined sheet than the first position is.

3. The sheet stacking apparatus according to claim 1, wherein the controller controls the stacking tray such that the number of the predetermined sheets in a case where each predetermined sheet has a first grammage that is less than a predetermined grammage is smaller than the number of predetermined sheets in a case where each predetermined sheet has the predetermined grammage.

4. The sheet stacking apparatus according to claim 1, the controller controls the stacking tray such that the number of predetermined sheets in a case where each predetermined sheet has one line of perforation is smaller than the number of predetermined sheets in a case where each predetermined sheet has two lines of perforation.

5. An image forming system comprising:

an image forming apparatus configured to form an image on a sheet;

a perforation apparatus configured to provide perforation on the sheet on which the image is formed by the image forming apparatus;

a conveyance mechanism configured to convey the sheet on which the perforation is provided by the perforation apparatus;

a stacking tray configured to stack the sheet conveyed by the conveyance mechanism; and a controller configured to stop a stacking operation of the sheet on the stacking tray based on a number of predetermined sheets stacked on the stacking tray, wherein the number of predetermined sheets in a case where each of the predetermined sheets has a perforation thereon is less than the number of predetermined sheets in a case where each of the predetermined sheets has no perforation thereon.

6. The image forming system according to claim 5, wherein the controller controls the stacking tray such that the number of predetermined sheets in a case where each predetermined sheet has the perforation at a first position is less than the number of predetermined sheets in a case where each predetermined sheet has the perforation at a second position nearer an edge of the predetermined sheet than the first position is.

7. The image forming system according to claim 5, wherein the controller controls the stacking tray such that the number of predetermined sheets in a case where each predetermined sheet has a first grammage that is less than a predetermined grammage is smaller than the number of predetermined sheets in a case where each predetermined sheet has the predetermined grammage.

8. The image forming system according to claim 5, wherein the controller controls the stacking tray such that the number of predetermined sheets in a case where each predetermined sheet has one line of perforation is smaller than the number of predetermined sheets in a case where each predetermined sheet has two lines of perforation.

9. An information processing apparatus comprising:

a memory configured to store a control program configured to control a stacking operation of a sheet on a stacking apparatus on which a sheet having been subjected to a perforation processing by a perforation apparatus and a sheet having been conveyed from an image forming apparatus without being subjected to the perforation processing by the perforation apparatus are stacked; and a processor configured to execute the control program, wherein, in a state where the program is executed by the processor, in a case where a predetermined sheet having been subjected to a predetermined perforation processing is stacked on the stacking apparatus, the processor is configured to stop the stacking of the sheet on the stacking apparatus based on a number of stacked sheets that is smaller than an upper limit of number of stacked sheets of a case where a predetermined sheet that has not been subjected to the perforation processing is stacked on the stacking apparatus.

10. The information processing apparatus according to claim 9, wherein the processor is configured to acquire a grammage information of the sheet being subjected to the perforation processing being stacked on the stacking apparatus, and wherein, in a case where a grammage of a predetermined sized sheet to which perforation processing has been performed that has been acquired is smaller than a predetermined grammage, the processor is configured to stop the stacking of sheets on the stacking apparatus based on a number of stacked sheets that is smaller than an upper limit of number of stacked sheets to the stacking apparatus of a case where the grammage of the predetermined sized sheet is equal to or greater than the predetermined grammage.

11. The information processing apparatus according to claim 9, wherein the processor acquires a number information of lines of the perforation on the sheet that has been subjected to the perforation processing and stacked on the stacking apparatus, and wherein, in a case where a number of lines of perforation on the predetermined sheet being acquired is one, the processor is configured to stop the stacking of the sheet on the stacking apparatus based on a number of stacked sheets that is smaller than an upper limit of number of stacked sheets of a case where a plurality of lines of perforation are provided on the predetermined sheet.

12. The information processing apparatus according to claim 9, wherein the processor acquires a position information of the perforation on the predetermined sheet that has been subjected to the perforation processing stacked on the stacking apparatus, and wherein, in a case where a position of the perforation being acquired is approximately a center in a sheet conveyance direction, the processor is configured to stop the stacking of the sheet on the stacking apparatus based on a number of stacked sheets that is smaller than an upper limit of number of stacked sheets of a case where a position at which the perforation is provided on the predetermined sheet is near a trailing edge in the sheet conveyance direction.

* * * * *